US005904735A

United States Patent [19]

Gutierrez et al.

[11] Patent Number: 5,904,735

[45] Date of Patent: May 18, 1999

[54] DETERGENT COMPOSITIONS CONTAINING POLYETHYLENEIMINES FOR ENHANCED STAIN REMOVAL

[75] Inventors: Eddie Gutierrez, Midland Park, N.J.; Shang-Ren Wu, Shanghai, China; Uday Racherla, Fort Lee; Robert Vermeer, Nutley, both of N.J.

[73] Assignee: Lever Brothers Company, New York, N.Y.

[21] Appl. No.: 08/905,581

[22] Filed: Aug. 4, 1997

[51] Int. Cl.[6] ..... C11D 1/40; C11D 7/22

[52] U.S. Cl. ..... 8/137; 510/320; 510/321; 510/337; 510/341; 510/356; 510/361; 510/392; 510/393; 510/405; 510/421; 510/433; 510/434; 510/499; 510/504

[58] Field of Search ..... 8/137; 510/320, 510/321, 323, 302, 303, 305, 392, 393, 367, 370, 374, 531, 533, 337, 341, 356, 361, 405, 421, 433, 434, 499, 504

[56] References Cited

U.S. PATENT DOCUMENTS

| | | | |
|---|---|---|---|
| 2,182,306 | 12/1939 | Ulrich et al. . | |
| 2,208,095 | 7/1940 | Esselmann et al. . | |
| 2,553,696 | 5/1951 | Wilson . | |
| 2,792,372 | 5/1957 | Dickson . | |
| 2,806,839 | 9/1957 | Crowther et al. . | |
| 3,033,746 | 5/1962 | Moyle et al. . | |
| 3,251,778 | 5/1966 | Dickson et al. . | |
| 3,259,512 | 7/1966 | Dickson et al. . | |
| 3,271,307 | 9/1966 | Dickson et al. . | |
| 3,400,198 | 9/1968 | Lang . | |
| 3,489,686 | 1/1970 | Parran et al. . | |
| 3,627,687 | 12/1971 | Teumac et al. . | |
| 3,636,213 | 1/1972 | Gerstein et al. . | |
| 3,740,422 | 6/1973 | Hewitt . | |
| 3,769,398 | 10/1973 | Hewitt . | |
| 3,844,952 | 10/1974 | Booth . | |
| 4,085,060 | 4/1978 | Vassileff . | |
| 4,171,278 | 10/1979 | Andree et al. . | |
| 4,341,716 | 7/1982 | Diery et al. . | |
| 4,561,991 | 12/1985 | Herbots et al. . | |
| 4,597,898 | 7/1986 | Vander Meer . | |
| 4,664,848 | 5/1987 | Oh et al. . | |
| 4,844,821 | 7/1989 | Mermelstein et al. | 510/328 |
| 4,913,828 | 4/1990 | Caswell et al. | 510/297 |
| 5,259,984 | 11/1993 | Hull . | |
| 5,356,977 | 10/1994 | Hsu . | |
| 5,360,581 | 11/1994 | Rizvi et al. . | |
| 5,417,965 | 5/1995 | Janchitraponvej et al. . | |

FOREIGN PATENT DOCUMENTS

| | | |
|---|---|---|
| 17813/95 | 12/1995 | Australia . |

*Primary Examiner*—Alan Diamond

[57] ABSTRACT

Detergent compositions, essentially free of peroxygen or chlorine bleach compounds, containing a surfactant, builder, enzyme and from about 0.001% to about 5% by weight polyethyleneimine (PEI) or salts thereof are disclosed. These compositions provide enhanced removal of organic stains, particularly on polyphenolic stains such as morello juice (cherry juice), blueberry juice, red wine, tea and coffee. Improvement was also demonstrated on certain non-polyphenolic stains such as grass.

21 Claims, No Drawings

DETERGENT COMPOSITIONS CONTAINING POLYETHYLENEIMINES FOR ENHANCED STAIN REMOVAL

FIELD OF THE INVENTION

The present invention relates to improved detergent compositions. Specifically, it relates to laundry detergent compositions, substantially free of peroxygen or chlorine bleach compounds, containing polyethyleneimine (PEI) sequestrants or salts thereof, which assist in the removal of food, beverage, and certain other organic stains from fabrics during the laundry process. PEI can be used as a replacement for all or part of the phosphonate chelants currently used in many existing laundry products, thereby yielding detergent formulations having reduced phosphorus content.

BACKGROUND OF THE INVENTION

Recently, in some geographical areas, there has been a growing concern regarding the use of phosphorus-containing compounds in laundry detergent compositions because of some evidence that links such compounds to the eutrophication of lakes and streams. While it is not clear whether or not this link is really significant, some governmental bodies have begun to restrict the phosphorus content of detergent compositions, necessitating the formulation of laundry detergents containing chelants less effective than the conventionally-used phosphonates or polyphosphonates. These requirements have complicated the formulation of effective and appropriately priced laundry detergent compositions. It would, therefore, be highly desirable to be able to formulate detergent compositions substantially free of peroxygen or chlorine bleach compounds which contain reduced levels of phosphorous-containing components, but still exhibit excellent cleaning and stain removal performance.

Accordingly, it is an object of the present invention to provide novel detergent compositions which exhibit improved stain and soil removal characteristics.

It is another object of the present invention to provide novel laundry detergent compositions substantially free of peroxygen or chlorine bleach compounds which still exhibit excellent cleaning and stain removal performance.

It is another object of the present invention to provide novel laundry detergent compositions substantially free of peroxygen or chlorine bleach compounds which exhibit excellent cleansing and stain removal performance, particularly under harsh water conditions.

It is a final object of the present invention to provide novel laundry detergent compositions which contain PEI's, as nil-phosphorous chelants.

These and other objects of the invention will be more readily apparent in the description that follows.

The use of PEI sequestrants in various compositions are generally disclosed in the art.

U.S. Pat. No. 3,033,746 to Moyle et al. discloses compositions comprising PEI for use in coating, oil/latex paint and cellulosic applications. The compositions are said to have improved antimicrobial properties by combining halophenol compounds with PEI.

WO 94/27621 to Mandeville discloses a method of reducing iron absorption from the gastrointestinal tract by orally administering a therapeutic amount of PEI.

U.S. Pat. No. 4,085,060 to Vassileff discloses sequestering compositions for industrial applications comprising polycarboxylate polymers and PEI which have excellent sequestering properties for metals.

U.S. Pat. No. 3,636,213 to Gerstein discloses a method for solubilizing heavy metal salts of 1-hydroxy-2-pyridinethione in cosmetic formulations where PEI functions as a solubilizing agent.

U.S. Pat. No. 3,400,198 to Lang discloses wave set retention shampoo compositions containing PEI. The compositions are said to precipitate on the hair fiber when diluted with water in the course of usage. Upon drying, PEI improves the wave retention of the hair as well as improving hair manageability. No builders or enzymes are present in such compositions.

U.S. Pat. No. 3,740,422 to Hewitt and U.S. Pat. No. 3,769,398 to Hewitt disclose aqueous and aqueous alcoholic scalp rinses containing solubilized PEI. It is said that PEI is effective against Pityrosporum ovale, the fungus believed to be associated with dandruff and therefore PEI serves as an anti-dandruff agent. No builders or enzymes would be present in such compositions.

British Patent No. 1,524,966 (to Reckitt and Colman Products) and British Patent No. 1,559,823 (to Reckitt and Colman Products) disclose anti-dandruff shampoo compositions comprising PEI as a conditioning agent for hair and as an antimicrobial agent. Again, no detergency builders or enzymes would be present in such compositions.

U.S. Pat. No. 5,360,581 to Rizvi et al. and U.S. Pat. No. 5,417,965 to Janchitraponvej et al. disclose conditioning shampoo compositions containing PEI. It is said that protonated PEI's with cationic polyquaternium 32 provide improved stability and conditioning benefits. No detergency builders or enzymes would be present in such compositions.

U.S. Pat. No. 3,251,778 to Dickson et al., U.S. Pat. No. 3,259,512 to Dickson et al. and U.S. Pat. No. 3,271,307 to Dickson et al. disclose processes for preparing PEI's and derivatives thereof. It is suggested that PEI's can be broadly used in various applications such as oil well treatment, asphalt applications, textile applications and the like.

U.S. Pat. No. 5,259,984 to Hull discloses a rinse free cleaner composition for hands, upholstery and carpet containing PEI.

U.S. Pat. No. 2,182,306 to Ulrich, U.S. Pat. No. 2,208,095 to Esselmann, U.S. Pat. No. 2,553,696 to Wilson, U.S. Pat. No. 2,806,839 to Crowther and U.S. Pat. No. 3,627,687 to Teumac et al. disclose methods of preparing various PEI's.

U.S. Pat. No. 3,844,952 to Booth discloses detergent and fabric softener compositions containing alkylated and alkanoylated PEI's as antistatic agents. The alkylated or alkanoylated polyethyleneimines disclosed by Booth differ structurally from the polyethyleneimines and polyethyleneimine salts (or mixtures) of the invention which are not derivatized.

Furthermore, there are numerous patents that describe various alkoxylated derivatives of PEI (similar to those described by Booth) which are also structurally very different and are otherwise unrelated to the present invention. See for example, U.S. Pat. Nos. 2,792,372, 4,171,278, 4,341,716, 4,597,898, 4,561,991, 4,664,848, 4,689,167 and 4,891,160.

Finally, perhaps the most relevant references that do disclose the use of polyethyleneimines in detergent compositions are as follows.

U.S. Pat. No. 3,489,686 to Parran, for example, discloses detergent compositions containing certain PEI's which serve to enhance deposition and retention of particulate substances an surfaces washed with such compositions. There is no teaching or suggestion that polyethyleneimines be used in compositions substantially free of enzymes.

AU Patent No. 17813/95 (to Procter & Gamble) and JP 08,053,698 (to Procter & Gamble) disclose detergent compositions containing 0.01% to 10% PEI substantially free of tertiary amino groups having a specific molecular weight of 100–600 as a polymeric chlorine scavenger. The compositions are said to minimize fading of fabric colors sensitive to chlorine which may be present in the composition or in the wash or rinse water. The compositions optionally contain peroxygen or chlorine bleaching agents.

Once again compositions of the subject invention are free of peroxygen or chlorine bleach compounds, include builders and enzymes, and provide excellent cleansing and stain removal characteristics without bleaching action, even under harsh wash water conditions.

Accordingly, none of the above patents or applications disclose the improved compositions of the present invention or recognize the unique fabric stain removal properties of PEI or PEI salts (or mixtures thereof) in the context of laundry detergent compositions substantially free of bleach.

SUMMARY OF THE INVENTION

The compositions of this invention are laundry detergents comprising:

(a) from about 1% to about 75% by weight of a detergent surfactant selected from the group consisting of anionic surfactants, nonionic surfactants, zwitterionic surfactants, ampholytic surfactants, cationic surfactants, and mixtures thereof;

(b) from about 5% to about 80% by weight of a primary detergency builder;

(c) from about 0.001% to about 5% by weight of an enzyme;

(d) from about 0.001% to about 5% by weight of PEI, PEI salts, or mixtures thereof; and (e) the remainder is water and additional optional detersive ingredients; wherein the compositions are substantially free of bleach.

Accordingly, it is an object of the present invention to provide improved novel laundry detergent compositions containing PEI as nil-phosphorus chelant which possess improved stain removal characteristics and are substantially free of peroxygen or chlorine bleaching agents.

This and other objects as well as additional advantages will appear as the description proceeds.

DETAILED DESCRIPTION OF THE INVENTION

The essential and less essential components of the present invention are described in detail below.

(a) The Detergent Surfactant

The amount of detergent surfactant included in the detergent compositions of the present invention can vary from about 1% to about 75% by weight of the composition depending upon the particular surfactant(s) used, the type of composition to be formulated (e.g., granular, liquid, etc.) and the effects desired. Preferably, the detergent surfactant(s) comprises from about 5% to about 60% by weight of the composition. The detergent surfactant can be nonionic, anionic, ampholytic, zwitterionic, or cationic. Mixtures of these surfactants can also be used.

A. Nonionic Surfactants

Suitable nonionic surfactants are generally disclosed in U.S. Pat. No. 3,929,678, Laughlin et al., issued Dec. 30, 1975, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation; and Triton X-45, X-114, X-100, and X-102, all marketed by the Rohm & Haas Company.
2. The condensation products of aliphatic alcohols with from about 1 to 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol 15-S-9 (the condensation product of $C_{11}$–$C_{15}$ linear alcohol with 9 moles ethylene oxide), marketed by Union Carbide Corporation; Neodol 45-9 (the condensation product of $C_{14}$–$C_{15}$ linear alcohol with 9 moles of ethylene oxide, Neodol 23-6.5 (the condensation product of $C_{12}$–$C_{13}$ linear alcohol with 6.5 moles of ethylene oxide), Neodol 45-7 (the condensation product of $C_{14}$–$C_{15}$ linear alcohol with 7 moles of ethylene oxide), and Neodol 45-4 (the condensation product of $C_{14}$–$C_{15}$ linear alcohol with 4 moles of ethylene oxide), marketed by Shell Chemical Company.
3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.
4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic detergent surfactants are the amine oxide surfactants having the formula:

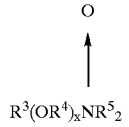

$$R^3(OR^4)_xNR^5{}_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. $R^5$ groups can be attached to each other, e.g., through an oxygen or nitrogen atom, to form a ring structure.

Preferred amine oxide surfactants are $C_{10}$–$C_{18}$ alkyldimethylamine oxides and $C_8$–$C_{12}$ alkoxyethyldihydroxyethylamine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1½ to about 10, preferably from about 1½ to about 3, most preferably from about 1.6 to about 2.7 saccharide units. Any reducing saccharide containing 5 or 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units.

Optionally, and less desirably, there can be a polyalkylene oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglycosides. The preferred alkylpolyglycosides have the formula:

$$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1½ to about 10, preferably from about 1½ to about 3, most preferably from about 1.6 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. The fatty acid amide surfactants having the formula:

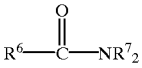

wherein $R^6$ is an alkyl group containing from about 7 to about 21 (preferably from about 9 to about 17) carbon atoms and each, $R^7$ is selected from the group consisting of hydrogen, $C_1$–$C_4$ alkyl, $C_1$–$C_4$ hydroxyalkyl, and $—(C_2H_4O)_xH$ where x varies from about 1 to about 3.

Preferred amides are $C_8$–$C_{20}$ ammonia amides, monoethanolamides, diethanolamides, and isopropanolamides.

8. The polyhydroxy fatty acid amide surfactants (alkyl glycamides) having the formula:

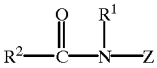

wherein: $R^1$ is H, $C_1$–$C_4$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyl groups directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As for raw materials, high dextrose corn syrup, high fructose corn syrup, and high maltose corn syrup can be utilized as well as the individual sugars listed above. These corn syrups may yield a mixture of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, (inclusive) and R' is H or a cyclic or aliphatic monosaccharide. Most preferred are glycityls wherein n is 4, particularly $—CH_2—(CHOH)_4—CH_2OH$.

In the above formula R' can be, for example, N-methyl, N-ethyl, N-propyl, N-isopropyl, N-butyl, N-2-hydroxyethyl, or N-2-hydroxypropyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

9. The N-alkoxy and N-aryloxy polyhydroxy fatty acid amide surfactants (alkyl glycamides) having the formula:

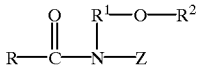

wherein R is $C_7$–$C_{21}$ hydrocarbyl, preferably $C_9$–$C_{17}$ hydrocarbyl, including straight-chain (preferred), branched-chain alkyl and alkenyl, as well as substituted alkyl and alkenyl, e.g., 12-hydroxy oleic, or mixtures thereof; $R_1$ is $C_2$–$C_8$ hydrocarbyl including straight-chain, branched-chain and cyclic (including aryl), and is preferably $C_2$–$C_4$ alkylene, i.e., $—CH_2CH_2—$, $—CH_2CH_2CH_2—$ and $—CH_2(CH_2)_2CH_2—$; and $R^2$ is $C_1$–$C_8$ straight-chain, branched-chain and cyclic hydrocarbyl including aryl and oxyhydrocarbyl, and is preferably $C_1$–$C_4$ alkyl or phenyl; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As for raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or polysaccharide, and alkoxylated derivatives thereof. Most preferred are glycityls wherein n is 4, particularly $—CH_2—(CHOH)_4—CH_2OH$.

In compounds of the above formula, nonlimiting examples of the amine substituents group $—R^1O—R^2$ can be, for example: 2-methoxyethyl-, 3-methoxy-propyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopro-poxypropyl-, 2-(t-butoxy)ethyl-, 3-(t-butoxy)propyl-, 2-(isobutoxy)ethyl-, 3-(iso-butoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranyl-oxyethyl-, 3-[2-methoxyethoxy]propyl-, 2-[2-methoxyethoxy]ethyl-, 3-[3-methoxypropoxy]propyl-, 2-[3-methoxypropoxy]ethyl-, 3-[methoxypolyethyleneoxy]propyl-, 3-[4-methoxybutoxy]propyl-, 3-[2-methoxyisopropoxy]propyl-, $CH_3O—CH_2CH(CH_3)—$ and $CH_3—OCH_2CH(CH_3)CH_2—O—(CH_2)_3—$.

$R—CO—N<$ can be, for example, cocamide, stearamide, oleamide, lauramide, myristamide, capricamide, palmitamide, tallowamide, ricinolamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

10. The aldonamides and aldobionamides disclosed in U.S. Pat. Nos. 5,296,588; 5,336,765; 5,386,018; 5,389,279; 5,401,426 and 5,401,839 as well as WO 94/12511 which are all incorporated herein by reference.

Aldobionamides are defined as the amide of an aldobionic acid (or aldobionolactone) and an aldobionic acid is a sugar substance (e.g., any cyclic sugar comprising at least two saccharide units) wherein the aldehyde group (generally found at the $C_1$ position of the sugar) has been replaced by a carboxylic acid, which upon drying cyclizes do an aldonolactone.

An aldobionamide may be based on compounds comprising two saccharide units (e.g., lactobionamides or maltobionamides, etc.) or they may be based on compounds comprising more than two saccharide units (e.g., maltotrionamides), as long as the terminal sugar in the polysaccharide has an aldehyde group. By definition an aldobionamide must have at least two saccharide units and cannot be linear. Disaccharide compounds such as lactobionamides or maltobionamides are preferred compounds. Other examples of aldobionamides (disaccharides) which may be used include cellobionamides, melibionamides and gentiobionamides.

A specific example of an aldobionamide which may be used for purposes of the invention is the disaccharide lactobionamide set forth below:

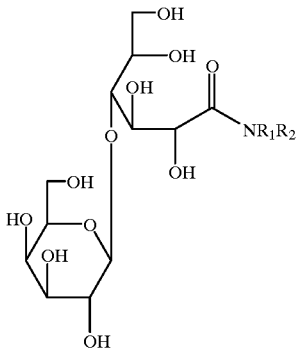

wherein $R_1$ and $R_2$ are the same or different and are selected from the group consisting of hydrogen; an aliphatic hydrocarbon radical (e.g., alkyl groups and alkene groups which groups may contain heteroatoms such as N, O or S or alkoxylated alkyl chains such as ethoxylated or propoxylated alkyl groups, preferably an alkyl group having 6 to 24, preferably 8 to 18 carbons; an aromatic radical (including substituted or unsubstituted aryl groups and arenes); a cycloaliphatic radical; an amino acid ester, ether amines and mixtures thereof. It should be noted that $R_1$ and $R_2$ cannot be hydrogen at the same time.

B. Anionic Surfactants

Anionic surfactants suitable for use in the present invention are generally disclosed in U.S. Pat. No. 3,929,678, Laughlin et al., issued Dec. 30, 1975, at column 23, line 58 through column 29, line 23, incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium cocoate, sodium stearate, sodium oleate and potassium palmitate as well as fatty alcohol ether methylcarboxylates and their salts.
2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups).

Examples of this group of anionic surfactants are the sodium and potassium alkyl sulfates, especially those obtained by sulfating the higher alcohol ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. No. 2,220,099, Guenther et al., issued Nov. 5, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$ LAS.

Another group of preferred anionic surfactants of this type are the alkyl polyalkoxylate sulfates, particularly those in which the alkyl group contains from about 8 to about 22, preferably from about 12 to about 18 carbon atoms, and wherein the polyalkoxylate chain contains from about 1 to about 15 ethoxylate and/or propoxylate moieties, preferably from about 1 to about 3 ethoxylate moieties. These anionic detergent surfactants are particularly desirable for formulating heavy-duty liquid laundry detergent compositions.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 15 units of ethylene oxide per molecule and wherein the alkyl group contains from about 8 to about 22 carbon atoms.

Also included are water-soluble salts of esters of alpha sulfonated fatty acids containing from about 6 to about 20 carbon atoms in the fatty acid group and from about 1 to about 10 carbon atoms in the ester group; water-soluble salts of 2-acyloxyalkane-1-sulfonic acids containing from about 2 to about 9 carbon atoms in the acyl group and from about 9 to about 23 carbon atoms in the alkane moiety; water-soluble salts of olefin sulfonates containing from about 12 to about 24 carbon atoms; and beta alkyloxy alkane sulfonates containing from about 1 to about 3 carbon atoms in the alkyl group and from about 8 to about 20 carbon atoms in the alkane moiety as well as primary alkane sulfonates, secondary alkane sulfonates, α-sulfo fatty acid esters, sulfosuccinic acid alkyl esters, acylaminoalkane sulfonates (Taurides), sarcosinates and sulfated alkyl glycamides, sulfated sugar surfactants and sulfonated sugar surfactants.

Particularly preferred surfactants for use herein include alkyl benzene sulfonates, alkyl sulfates, alkyl polyethoxy sulfates and mixtures thereof. Mixtures of these anionic surfactants with a nonionic surfactant selected from the group consisting of $C_{10}$–$C_{20}$ alcohols ethoxylated with an average of from about 4 to about 10 moles of ethylene oxide per mole of alcohol are particularly preferred.

3. Anionic phosphate surfactants such as the alkyl phosphates and alkyl ether phosphates.
4. N-alkyl substituted succinamates.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate or sulfate. See U.S. Pat. No. 3,929,678, Laughlin et al., issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sultonium compounds. See U.S. Pat. No. 3,929,678, Laughlin et al., issued Dec. 30, 1975, column 19, line 38 through column 22, line 48, incorporated herein by reference, for examples of zwitterionic surfactants useful herein.

E. Cationic Surfactants

Cationic surfactants can also be included in detergent compositions of the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

Suitable cationic surfactants include the quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is independently selected from the group consisting of —$CH_2CH_2$—, —$CH_2CH(CH_3)$—, —$CH_2CH(CH_2OH)$—, and —$CH_2CH_2CH_2$—, each $R^4$ is independently selected from the group consisting of $C_1$–$C_4$ alkyl, $C_1$–$C_4$ hydroxyalkyl, benzyl, ring structures formed by joining the two $R^4$ groups, —$CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18, each y is from 0 to about 10 and the sum of the y values is from 0 to about 15; and X is any compatible anion.

Preferred examples of the above compounds are the alkyl quaternary ammonium surfactants, especially the monolong chain alkyl surfactants described in the above formula when $R_5$ is selected from the same groups as $R^4$. The most preferred quaternary ammonium surfactants are the chloride, bromide, and methylsulfate $C_8$–$C_{16}$ alkyl trimethylammonium salts, $C_8$–$C_{16}$ alkyl di(hydroxyethyl)methylammonium salts, the $C_8$–$C_{16}$ alkyloxypropyltrimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

A more complete disclosure of cationic surfactants useful herein can be found in U.S. Pat. No. 4,228,044, Cambre, issued Oct. 14, 1980, incorporated herein by reference.

(b) Detergent Builders

Detergent compositions of the present invention contain inorganic and/or organic detergent builders to assist in mineral hardness control. These builders comprise from about 5% to about 80% by weight of the compositions. Built liquid formulations preferably comprise from about 7% to about 30% by weight of detergent builder, while built granular formulations preferably comprise from about 10% to about 50% by weight of detergent builder.

Suitable detergent builders include crystalline aluminosilicate ion exchange materials having the formula:

$$Na_y[(AlO_2)_z(SiO_2)]xH_2O$$

wherein z and y are at least about 6, the mole ratio of z to y is from about 1.0 to about 0.5; and x is from about 10 to about 264. Amorphous hydrated aluminosilicate materials useful herein have the empirical formula $$M_y(zAlO_2ySiO_2)$$

wherein M is sodium, potassium, ammonium, or substituted ammonium, z is from about 0.5 to about 2; and y is 1; this material having a magnesium ion exchange capacity of at least about 50 milligram equivalents of $CaCO_3$ hardness per gram of anhydrous aluminosilicate.

The aluminosilicate ion exchange builder materials are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The preferred crystalline aluminosilicate ion exchange materials are further characterized by a particle size diameter of from about 0.1 micron to about 10 microns. Amorphous materials are often smaller, e.g., down to less than about 0.01 micron. More preferred ion exchange materials have a particle size diameter of from about 0.2 micron to about 4 microns. The term "particle size diameter" represents the average particle size diameter of a given ion exchange material as determined by conventional analytical techniques such as, for example, microscopic determination utilizing a scanning electron microscope. The crystalline aluminosilicate ion exchange materials are usually further characterized by their calcium ion exchange capacity, which is at least about 200 mg. equivalent of $CaCO_3$ water hardness/g of aluminosilicate, calculated on an anhydrous basis, and which generally is in the range of from about 300 mg eq/g to about 352 mg eq/g. The aluminosilicate ion exchange materials are still further characterized by their calcium ion exchange rate which is at least about 2 grains Ca++/gallon/minute/gram/gallon of aluminosilicate (anhydrous basis), and generally lies within the range of from about 2 grains/gallon/minute/gram/gallon to about 6/grains/gallon/minute/gram/gallon, based on calcium ion hardness. Optimum aluminosilicates for builder purposes exhibit a calcium ion exchange rate of at least about 4 grains/gallon/minute/gram/gallon.

The amorphous aluminosilicate ion exchange materials usually have a Mg++ exchange capacity of at least about 50 mg eq $CaCo_3$/g (12 mg Mg++/g) and a Mg++ exchange rate of at least about 1 grain/gallon/minute/gram/gallon. Amorphous materials do not exhibit an observable diffraction pattern when examined by Cu radiation (1.54 Angstrom Units).

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27.

Other detergency builders useful in the present invention include the alkali metal silicates, alkali metal carbonates, phosphates, polyphosphates, phosphonates, polyphosphonic acids, $C_{10-18}$ alkyl monocarboxylic acids, polycarboxylic acids, alkali metal ammonium or substituted ammonium salts thereof and mixtures thereof. Preferred are the alkali metal, especially sodium, salts of the above.

Specific examples of inorganic phosphate builders are sodium and potassium tripolyphosphate, pyrophosphate, polymeric metaphate having a degree of polymerization of from about 6 to about 21, and orthophosphate. Examples of polyphosphonate builders are the sodium and potassium salts of ethylene-1,1-diphosphonic acid, the sodium and potassium salts of ethane 1-hydroxy-1,1-diphosphonic acid and the sodium and potassium salts of ethane 1,1,2-triphosphonic acid. Other suitable phosphorus builder compounds are disclosed in U.S. Pat. No. 3,159,571, Diehl, issued Dec. 1, 1964; U.S. Pat. No. 3,213,030, Diehl, issued Oct. 19, 1965; U.S. Pat. No. 3,400,148, Quimby, issued Sep. 3, 1968; U.S. Pat. No. 3,400,176, Quimby, issued Sep. 3, 1968; U.S. Pat. No. 3,422,021, Roy, issued Jan. 14, 1969; and U.S. Pat. No. 3,422,137, Quimby, issued Sep. 3, 1968; all herein incorporated by reference. However, while suitable for use in compositions of the invention, one of the advantages of the present invention is that effective detergent compositions can be formulated using minimum levels or in the complete absence of phosphonates and phosphates.

The PEI sequestrants will provide improved stain and soil removal benefits in the presence and absence of phosphonate and/or phosphate builders or chelants.

Examples of nonphosphorus, inorganic builders are sodium and potassium carbonate, bicarbonate, sesquicarbonate, tetraborate decahydrate, and silicate having a mole ratio of $SiO_2$ to alkali metal oxide of from about 0.5 to about 4.0, preferably from about 1.0 to about 2.4.

Useful water-soluble, nonphosphorus organic builders include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid. For purposes of defining the invention, the organic detergent builder component which may be used herein does not comprise diaminoalkyl di(sulfosuccinate) (DDSS) or salts thereof.

Highly preferred polycarboxylate builders are disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates disclosed in U.S. Pat. No. 3,723,322, Diehl, issued Mar. 28, 1973, incorporated by reference herein.

A class of useful phosphorus-free detergent builder materials have been found to be ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972, both of which are incorporated herein by reference.

A specific type of ether polycarboxylates useful as builders in the present invention are those having the general formula:

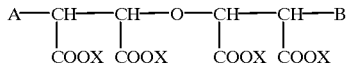

wherein A is H or OH; B is H or

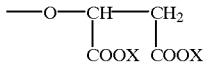

and X is H or a salt-forming cation. For example, if in the above general formula A and B are both H, then the compound is oxydisuccinic acid and its water-soluble salts. If A is OH and B is H, then the compound is tartrate monosuccinic acid (TMS) and its water soluble salts. If A is H and B is

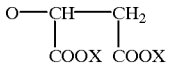

then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

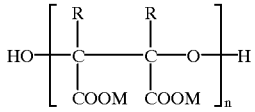

wherein M is hydrogen or a cation wherein the resultant salt is water soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Other useful builders include the $C_5$–$C_{20}$ alkyl succinic acids and salts thereof. A particularly preferred compound of this type is dodecenylsuccinic acid.

Useful builders also include sodium and potassium carboxymethyloxy-malonate, carboxymethyloxysuccinate, cis-cyclohexanehexacarboxylate, cis-cyclopentanetetracarboxylate, phloroglucinol trisulfonate, water soluble poly-acrylates (having molecular weights of from about 2,000 to about 200,000, for example), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Especially useful detergency builders include the $C_{10}$–$C_{18}$ alkyl monocarboxylic (fatty) acids and salts thereof. These fatty acids can be derived from animal and vegetable fats and oils, such as tallow, coconut oil and palm oil. Suitable saturated fatty acids can also be synthetically prepared (e.g., via the oxidation of petroleum or by hydrogenation of carbon monoxide via the Fisher-Tropsch process). Particularly preferred $C_{10}$–$C_{18}$ alkyl monocarboxylic acids are saturated coconut fatty acids, palm kernel fatty acids, and mixtures thereof.

Other useful detergency builder materials are the "seeded builder" compositions disclosed in Belgian Patent No. 798,836, published Oct. 29, 1973, incorporated herein by reference. Specific examples of such seeded builder mixtures are 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

(c) Enzymes

Enzymes can be included in the formulations herein for a wide variety of fabric laundering purposes, including removal of protein-based, carbohydrate-based, or triglyceride-based stains, for examples, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1%, by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (See European Patent Application No. 130 756 published Jan. 9, 1985) and Protease B (See European Patent Application Serial No. 87303761.8 filed Apr. 28, 1987, and European Patent Application No. 130 756, Bott et al., published Jan. 9, 1985).

Amylases include, for example, a-amylases described in British Patent Specification No. 1,296,839 (Novo), RAPIDASE, Internation Bio-Synthetics, Inc. and TERMAMYL, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al., issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB A-2.075.028; GB A-2.095.275 and DE-OS-2.247.832.

Suitable lipase enzymes for detergent usage include those produced by microorganisms of the Pseudomonas group, such as *Pseudomonas stutzeri* ATCC19.154, as disclosed in British Patent 1,372,034. See also lipases in Japanese Patent Application 53-20487, laid open to public inspection on Feb. 24, 1978. This lipase is available from Amano Pharmaceutical Co. Ltd., Nagoya, Japan, under the tradename Lipase P "Amano", hereinafter referred to as "Amano-P". Other commercial lipases include Amano-CES, lipases ex Chromobacter viscosum. e.g., Chromobacter viscosum var, lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (See also EPO 341,947) is a preferred lipase for use herein.

Peroxidase enzymes are used in combination with oxygen sources, e.g., percarbonate, perborate, persulfate, hydrogen peroxide, etc. They are used for "solution bleaching", i.e., to prevent transfer of dyes or pigments removed from substrates during wash operations to other substrates in the wash solution. Peroxidase enzymes are known in the art, and include, for examples, horseradish peroxidase, ligninase, and haloperoxidase such as chloro- and bromoperoxidase. Peroxidase-containing detergent compositions are disclosed, for example, in PCT International Application WO 89/099813, published Oct. 19, 1989 by O. Kirk, assigned to Novo Industries A/S.

A wide range of enzyme materials and means for their incorporation into synthetic detergent granules are also disclosed in U.S. Pat. No. 3,553,139, issued Jan. 5, 1971, to McCarty et al. Enzymes are further disclosed in U.S. Pat. No. 4,101,457, Place et al., issued Jul. 18, 1978, and in U.S. Pat. No. 4,507,219, Hughes, issued Mar. 26, 1985, both. Enzyme materials useful for detergent formulations, and their incorporation into such formulations, are disclosed in U.S. Pat. No. 4,261,868, Hora et al., issued Apr. 14, 1981. Enzymes for use in detergents can be stabilized by various techniques. Enzyme stabilization techniques are disclosed and exemplified in U.S. Pat. No. 4,261,868 issued Apr. 14, 1981, to Horn et al., U.S. Pat. No. 3,600,319 issued Aug. 17, 1971 to Gedge et al., and European Patent Application No. 0 199 405, Application No. 86200586.6, published Oct. 29, 1986, Venegas. Enzyme stabilization systems are also described for example, in U.S. Pat. Nos. 4,261,868; 3,600,319 and 3,519,570. For example, the enzymes employed herein can be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used). Additional stability can be provided by the presence of various other art-disclosed stabilizers, especially borate species: See Severson, U.S. Pat. No. 4,537,706, cited above. Typical detergents, especially liquids, will comprise from about 1 to about 30, preferably from about 2 to about 20, more preferably from about 5 to about 15, and most preferably from about 8 to about 12, millimoles of calcium ion per kilo of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per kilo, is often also present in the composition due to calcium in the enzyme slurry and formula water. In granular detergent compositions, the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, the compositions herein may comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

(d) Polyethyleneimines (PEI's)

The polyethyleneimines (PEI's) suitable for use in the detergent compositions of the present invention can have the general formula, although the actual formula is not exactly known:

$$(\text{—NHCH}_2\text{CH}_2\text{—})_x[\text{—N(CH}_2\text{CH}_2\text{NH}_2)\text{CH}_2\text{CH}_2\text{—}]_y$$

wherein x is an integer from about 1 to about 120,000, preferably from about 2 to about 60,000, more preferably from about 3 to about 24,000 and y is an integer from about 1 to about 60,000, preferably from about 2 to about 30,000, more preferably from about 3 to about 12,000. Specific examples of polyethyleneimines are PEI-3, PEI-7, PEI-15, PEI-30, PEI-45, PEI-100, PEI-300, PEI-500, PEI 600, PEI-700, PEI-800, PEI-1000, PEI-1500, PEI-1800, PEI-2000, PEI-2500, PEI-5000, PEI-10,000, PEI-25,000, PEI 50,000, PEI-70,000, PEI-500,000, PEI-5,000,000 and the like, wherein the integer represents the average molecular weight of the polymer. PEI's which are designated as such are available through Aldrich.

PEI's are usually highly branched polyamines characterized by the empirical formula $(C_2H_5N)_n$ with a molecular mass of 43.07 (as repeating units). They are commercially prepared by acid-catalyzed ring opening of ethyleneimine, also known as aziridine. (The latter, ethyleneimine, is prepared through the sulfuric acid esterification of ethanolamine). The reaction scheme is shown below:

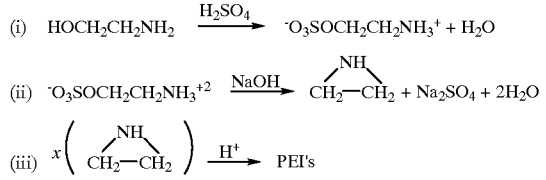

Polyethyleneimines can have an average molecular weight of about 100 to about 5,000,000 or even higher. Any polyethyleneimine is suitable for use in the present invention, however the preferred polyethyleneimines are branched and have a typical average molecular weight of up to about 3,000,000, preferably from about 300 to about 2,500,000, more preferably from about 400 to about 1,000,000.

PEI's are commercially available from the BASF Corporation under the trade name Lupasol® (also sold as Polymin®). These compounds can prepared as a wide range of molecular weights and product activities. Examples of commercial PEI's sold by BASF suitable for use in the present invention include, but are not limited to, Lupasol FG®, Lupasol G-35®), Lupasol-P®, Lupasol-PS®, Lupasol-(Water-Free)® and the like.

PEI's are also commercially available from Polymer Enterprises or Nippon Soda (of Japan) under the trade name Epomin®. Examples of commercial PEI's sold by Polymer Enterprises or Nippon Soda suitable for use in the present invention include, but are not limited to Epomin SP012®, Epomin P1050®, Epomin SP103®, Epomin SP003®, Epomin SP006® and the like.

Other frequently used commercial trade names for PEI suitable for use in present invention include, but are not limited to Polyazinidine®, Corcat®, Montek®, Polymin P® and the like.

The amine groups of PEI exist mainly as a mixture of primary, secondary and tertiary groups in the ratio of about 1:1:1 to about 1:2:1 with branching every 3 to 3.5 nitrogen atoms along a chain segment. Because of the presence of amine groups, PEI can be protonated with acids to form a PEI salt from the surrounding medium resulting in a product that is partially or fully ionized depending on pH. For example, about 73% of PEI is protonated at pH 2, about 50% of PEI is protonated at pH 4, about 33% of PEI is protonated at pH 5, about 25% of PEI is protonated at pH 8 and about 4% of PEI is protonated at pH 10. Therefore, since the detergent compositions of the present invention are buffered at a pH of about 6 to about 11, this suggests that PEI is about 4–30% protonated and about 70–96% unprotonated.

In general, PEI's can be purchased as their protonated or unprotonated form with and without water. When protonated PEI's are formulated in the compositions of the present invention they are deprotonated to a certain extent by adding a sufficient amount of suitable base. The deprotonated form of PEI is the preferred form, however moderate amounts of protonated PEI can be used and do not significantly detract from the present invention.

An example of a segment of a branched protonated polyethyleneimine (PEI salt) is shown below:

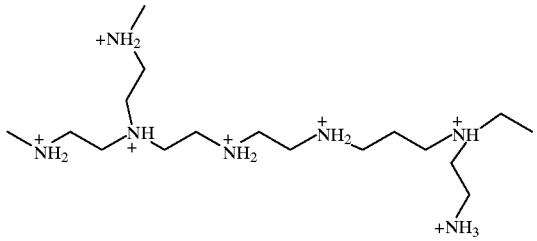

The counterion of each protonated nitrogen center is balanced with an anion of an acid obtained during neutralization.

Examples of protonated PEI salts include, but are not limited to, PEI-hydrochloride salt, PEI-sulfuric acid salt, PEI-nitric acid salt, PEI-acetic acid salt PEI fatty acid salt and the like. In fact, any acid can be used to protonate PEI's resulting in the formation of the corresponding PEI salt compound.

It has now been found, according to the present invention, that polyethyleneimines should not be used in amounts greater than 5% by weight of detergent formulation since they interfere with anionic ingredients in the detergent formulation and/or wash water. Without being bound by theory, it is believed that in an anionic ingredient system, pairing of PEI with anionic ingredients (anionic surfactants) as well as soaps (carboxylates) or other charged species (polycarboxylates) tends to lower the solubility and activity of PEI as well as reduce the activity of the anionic ingredient system. This of course can be completely prevented by formulating in the absence of such anionic ingredients, for example in the presence of an all nonionic ingredient system.

It should be noted that linear polyethyleneimines as well as mixtures of linear and branched polyethyleneimines are useful in the compositions of the present invention. Linear PEI's are obtained by cationic polymerization of oxazoline and oxazine derivatives. Methods for preparing linear PEI (as well as branched PEI) are more fully described in Advances in Polymer Science, Vol. 102, pgs. 171–188, 1992 (references 6–31) which is incorporated in its entirety herein by reference.

The level of PEI used in the compositions of the present invention is from about 0.001% to about 5%, preferably from about 0.005% to about 4.5%, more preferably from about 0.01% to about 4%. The addition of PEI to the detergent compositions of the present invention unexpectedly results in the enhanced removal of stains such as grass, morello juice (cherry juice), blueberry juice, red wine, tea, coffee and the like from the surface of fabric. Furthermore, PEIs were found to be surprisingly effective under harsh water conditions particularly, in the presence of high levels of hardness/transition metal ions, ($Ca^{+2}$, $Mg^{+2}$, $Fe^{+3}$, $Cu^{+2}$, $Zn^{+2}$, $Mn^{+2}$ and the like). These findings are unexpected and have not been disclosed in the art.

(e) Optional Detergent Ingredients

The compositions herein can optionally include one or more additional detersive materials or other ingredients for assisting or enhancing cleaning performance, treatment of the substrate to be cleaned, or to modify the aesthetics of the detergent composition (e.g., perfumes, colorants, dyes, etc.). The following are illustrative examples of such materials.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segments does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably poly(vinyl acetate), having a degree of polymerization of at least 2 or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixture therein, and such cellulose derivatives are amphophilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 2 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988, to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; See U.S. Pat. No. 4,000,093, issued Dec. 28, 1976, to Nicol et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application No. 0 219 048 published Apr. 22, 1987 by Kud et al. Commercially available soil release agents of this kind include the SOKALAN type of material, e.g., SOKALAN HP-22, available from BASF (West Germany).

One type of soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976, and U.S. Pat. No. 3,893,929 to Basadur issued Jul. 8, 1975.

Another polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also, U.S. Pat. No. 4,702,857, issued Oct. 27, 1987 to Gosselink.

Another polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink.

Other suitable polymeric soil release agents include the terephthalate polyesters of U.S. Pat. No. 4,711,730 issued Dec. 8, 1987 to Gosselink et al., the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Still other polymeric soil release agents also include the soil release agents of U.S. Pat. No. 4,877,896, issued Oct. 31, 1989 to Maldonado et al., which discloses anionic, especially sulfoaroyl, end-capped terephthalate esters.

If utilized, soil release agents will generally comprise from about 0.01% to about 10.0% by weight, of the detergent compositions herein, typically from about 0.1% to about 5%, preferably from about 0.2% to about 3.0%.

Co-chelating Agents

The detergent compositions herein may also optionally contain one or more iron and/or manganese co-chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates. N-Hydroxyethylethylenediaminetriacetates, nitrilotriacetates, ethylenediamine tetrapropionates, triethylenetetraaminehexaacetates, diethylenetriaminepentaacetates, ethylenediaminedisuccinate, diaminoalkyl di(sulfosuccinates) and ethanoldiglycines, alkali metal, ammonium, and substituted ammonium salts therein and mixtures thereof.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates) as DEQUEST. Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 3.0% by weight of such composition.

Clay Soil Removal/Anti-Redeposition Agents

The compositions of the present invention can also optionally contain water-soluble ethoxylated amines having clay soil removal and anti-redeposition properties. Granular detergent compositions which contain these compounds typically contain from about 0.01% to about 10.0% by weight of the water-soluble ethoxylated amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal/antiredeposition agents are the cationic compounds disclosed in European Patent Application 111 965, Oh and Gosselink, published Jun. 27, 1984. Other clay soil removal/antiredeposition agents which can be used include the ethoxylated amine polymers disclosed in European Patent Application 111 984, Gosselink, published Jun. 27, 1984; the zwitterionic polymers disclosed in European Patent Application 112 592, Gosselink, published Jul. 4, 1984; and the amine oxides disclosed in U.S. Pat. No. 4,548,744, Connor, issued Oct. 22, 1985. Other clay soil removal and/or antiredeposition agents known in the art can also be utilized in the compositions herein. Another type of preferred antiredeposition agent includes the carboxymethyl cellulose (CMC) materials. These materials are well known in the art.

Polymeric Dispersing Agents

Polymeric dispersing agents can advantageously be utilized at levels from about 0. 1% to about 7%, by weight in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinyl methyl ether, styrene, ethylene, etc., is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66 915, published Dec. 15, 1982.

Another polymeric material which can be included is polyethylene glycol (PEG). This agent PEG, can exhibit dispersing agent performance as well as act as a clay soil removal/antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders.

Brightener

Any optical brighteners or other brightening or whitening agents known in the art can be incorporated at levels typically from about 0.05% to about 1.2% by weight, into the detergent compositions herein. Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Arctic White CWD, available from Hilton-Davis, located in Italy; the 2-(4 -styrylphenyl)-2H-naphthol[1,2-d]triazoles; 4,4'-bis'(1,2,3-triazol-2-yl)stilbenes; 4,4'-bis(styryl)bisphenyls; and the aminocoumarins. Specific examples of these brighteners include 4-methyl-7-diethylaminocoumarin; 1,2-bis(benzimidazol-2-yl)ethylene; 1,3-diphenylphrazolines; 2,5-bis(benzoxazol-2-yl)thiophene; 2-styrylnaphth[1,2-d]oxazole; and 2-(stilbene-4-yl-2H-naphtho[1,2-d]triazole. See also U.S. Pat. No. 3,646,015, issued Feb. 29, 1972, to Hamilton which is incorporated herein by reference.

Suds Suppressors

Compounds for reducing or suppressing the formation of suds can be incorporated into the compositions of the present invention. Suds suppression can be of particular importance under conditions such as those found in European-style front loading laundry washing machines, or in the concentrated detergency process of U.S. Pat. Nos. 4,489,455 and 4,478,574, or when the detergent compositions herein optionally include a relatively high sudsing adjunct surfactant.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acids and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexaalkylmelamines or di- to tetraalkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin", as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al. and European Patent Application No. 89307851.9, published Feb. 7, 1990 by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al., and in U.S. Pat. No. 4,652,392, Baginski et al., issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1500 cs at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), and not polypropylene glycol. The primary silicone suds suppressor is branched/crosslinked and not linear.

To illustrate this point further, typical laundry detergent compositions with controlled suds will optionally comprise from about 0.001 to about 1, preferably from about 0.01 to about 0.7, most preferably from about 0.05 to about 0.5 weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. No. 4,978,471, Starch, issued Dec. 18, 1990; and U.S. Pat. No. 4,983,316, Starch, issued Jan. 8, 1991; and U.S. Pat. Nos. 4,639,489 and 4,749,740, Aizawa et al. at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679; 4,075,118 and EP 150 872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2% by weight of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

In addition to the foregoing ingredients, the compositions herein can also be used with a variety of other adjunct ingredients which provide still other benefits in various compositions within the scope of this invention. The following illustrates a variety of such adjunct ingredients, but is not intended to be limiting therein.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with the fabric cleaning. Clay softeners can be used in combination with amine and cationic softeners, as disclosed, for example, in U.S. Pat. No. 4,375,416, Crisp et al., Mar. 1, 1983, and U.S. Pat. No. 4,291,071, Harris et al., issued Sep. 22, 1981. Mixtures of cellulase enzymes (e.g., CAREZYME, Novo) and clays are also useful as high-performance fabric softeners. Various nonionic and cationic materials can be added to enhance static control such as $C_8$–$C_{18}$ dimethylamino propyl glucamide, $C_8$–$C_{18}$ trimethylamino propyl glucamide ammonium chloride and the like.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structure: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

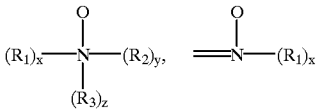

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which has an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth et al., *Chemical Analysis*, Vol. 113, "Modern Methods of Polymer Characterization", the disclosures of which are incorporated herein by reference). The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol (PEG) having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

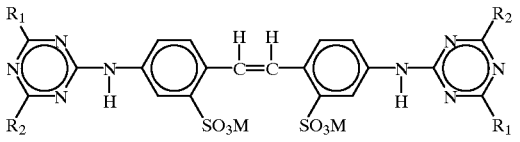

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxy-ethyl)-s-triazine-2-yl)amino]-2,2'-stilbenedisulfonic acid and disodium salt. This particular brightener species is commercially marketed under the tradename Tinopai-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6 -(N-2-hydroxyethyl-N-methylamino)-s-triazine-2-yl)amino]-2,2'-stilbenedisulfonicacid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]-2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone.

The detergent compositions of the present invention are substantially free of any peroxygen compounds. As used herein, "substantially free" means that the detergent compositions contain less than about 0.01%, preferably less than about 0.005%, by weight of a peroxygen compound. Examples of peroxygen compounds commonly used in bleaching solutions include hydrogen peroxide and its derivatives, such as alkali metal peroxides and superoxides, perborates, persulfates; and peracids, such as persulfonic acid, peracetic acid, peroxy monophosphoric acid and their water-soluble salts, especially their alkali metal, ammonium or organic amine salts; and urea-hydrogen peroxide addition product.

Other Ingredients

Other additional optional ingredients which are known or become known which can be present in detergent compositions of the invention (in their conventional art-established levels for use generally from 0.001% to about 50% by weight of the detergent composition), include solvents, hydrotropes, solubilizing agents, processing aids, soil-suspending agents, corrosion inhibitors, dyes, fillers, carriers, germicides, pH-adjusting agents, perfumes, static control agents, thickening agents, abrasive agents, viscosity control agents, solubilizing/clarifying agents, sunscreens/UV absorbers, phase regulants, foam boosting/stabilizing agents, antioxidants, metal ions, buffering agents, color speckles, encapsulation agents, deflocculating polymers, skin protective agents, color care agents and the like.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol EO(7) nonionic surfactant. Typically, the enzyme/surfactant solution is 2.5×the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, photoactivators, dyes, fluorescers, fabric conditioners and hydrolyzable surfactants can be "protected" for use in detergents, including liquid laundry detergent compositions.

Many additional essential and optional ingredients that are useful in the present invention are those described in McCutcheon's, *Detergents and Emulsifiers* (Vol. 1) and McCutcheon's, *Functional Materials* (Vol. 2), 1995 Annual Edition, published by McCutcheon's MC Publishing Co., as well as the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co. which are all incorporated herein by reference.

Powdered detergent composition might contain the following by weight:

(1) 1–75% detergent surfactant system;

(2) 5–80% builder;

(3) 0–30% buffer salt;

(4) 0–30% sulfate;

(5) 0.001–5% enzyme;

(6) 0.001–5% PEI;

(7) water and additional optional ingredients to 100%.

A preferred powdered detergent composition might contain the following by weight:

(1) 5–60% detergent surfactant system;

(2) 10–50% builder;

(3) 0–28% buffer salt;

(4) 0–28% sulfate;

(5) 0.001–3.5% enzyme;

(6) 0.01–4% PEI;

(7) water and additional optional ingredients to 100%.

A liquid detergent composition might contain the following by weight:

(1) 1–75% detergent surfactant system;

(2) 5–80% builder;

(3) 0–40% electrolyte;

(4) 0.001–5% enzyme;

(5) 0–15% enzyme stabilizer;

(6) 0–20% phase regulant;

(7) 0.001–5% PEI;

(8) water and additional optional ingredients to 100%.

A preferred liquid detergent composition might contain the following by weight:

(1) 5–60% detergent surfactant system;

(2) 7–30% builder;

(3) 0–30% electrolyte;

(4) 0.01–4% enzyme;

(5) 0.01–14% enzyme stabilizer;;

(6) 0–18% phase regulant;

(7) 0.01–4% PEI;

(8) water and additional optional ingredients to 100%.

Home Application and Use

The PEI chelants/sequestrants and their salts of the present invention are useful in a variety of detergent, personal product, cosmetic, oral hygiene, food, pharmacological and industrial compositions which are available in many types and forms. Preferred compositions, however, are detergent compositions.

A classification according to detergent type would consist of heavy-duty. detergent powders, heavy-duty detergent liquids, light-duty liquids (dishwashing liquids), machine dishwashing detergents, institutional detergents, specialty detergent powders, specialty detergent liquids, laundry aids, pretreatment aids, after treatment aids, presoaking products, hard surface cleaners, carpet cleansers, carwash products and the like.

A classification according to personal product type would consist of hair care products, bath products, cleansing products, skin care products, shaving products and deodorant/antiperspirant products.

Examples of hair care products include, but are not limited to rinses, conditioners, shampoos, conditioning shampoos, antidandruff shampoos, antilice shampoos, coloring shampoos, curl maintenance shampoos, baby shampoos, herbal shampoos, hair loss prevention shampoos, hair growth/promoting/ stimulating shampoos, hairwave neutralizing shampoos, hair setting products, hair sprays, hair styling products, permanent wave products, hair straightening/relaxing products, mousses, hair lotions, hair tonics, hair pomade products, brilliantines and the like.

Examples of bath products include, but are not limited to bath oils, foam or bubble bathes, therapeutic bathes, after bath products, after bath splash products and the like.

Examples of cleansing products include, but are not limited to shower cleansers, shower gels, body shampoos, hand/body/facial cleansers, abrasive scrub cleansing products, astringent cleansers, makeup cleansers, liquid soaps, toilet soap bars, synthetic detergent bars and the like.

Examples of skin care products include, but are not limited to hand/body/facial lotions, sunscreen products, tanning products, self-tanning products, aftersun products, masking products, lipsticks, lip gloss products, rejuvenating products, antiaging products, antiwrinkle products, anticellulite products, antiacne products and the like.

Examples of shaving products include, but are not limited to shaving creams, aftershave products, preshave products and the like.

Examples of deodorant/antiperspirant products include, but are not limited to deodorant products, antiperspirant products and the like.

A classification according to oral hygiene type would consist of, but is not limited to mouthwashes, pre-brushing dental rinses, post-brushing rinses, dental sprays, dental creams, toothpastes, toothpaste gels, tooth powders, dental cleansers, dental flosses, chewing gums, lozenges and the like.

The PEI chelant/sequestrant of the present invention are also useful in softening compositions such as liquid fabric softeners, fabric softening rinses, fabric softening sheets, tissue papers, paper towels, facial tissues, sanitary tissues, toilet paper and the like.

A classification according to composition form would consist of aerosols, liquids, gels, creams, lotions, sprays, pastes, roll-on, stick, tablet, powdered and bar form.

Industrial Application and Use

The PEI chelants/sequestrants and their ammonium salts of the present invention are useful in a variety of other compositions as above. More specifically, PEI is useful as chelants of heavy metal and hardness ions (builders), scale inhibiting agents, corrosion inhibiting agents, deflocculating/dispensing agents, stain removal agents, bleach stabilizing agents, protecting agents of peroxygen labile ingredients, photobleaching enhancing agents, thickener/viscosity modifying agents, crystal growth modification agents, sludge modification agents, surface modification agents, processing aids, electrolyte, hydrolytic stability agents, alkalinity agents and the like. The PEI chelant/sequestrant and its salts of the present invention are also useful for certain industrial applications such as acid cleaners, aluminum etching, boiler cleaning, water treatment, bottle washing, cement modification, dairy cleaners, desalination, electrochemical machining, electroplating, metal finishing, paper mill evaporations, oil field water treatment, paper pulp bleaching, pigment dispersion, trace metal carrier for fertilizers, irrigation, circuit cleaning and the like.

Detergent Formulations

Granular detergent compositions embodying the present invention can be formed by conventional techniques, i.e., by slurrying the individual components in water and then atomizing and spray-drying the resultant mixtures, or by pan or drum agglomeration of the ingredients. Granular formulations preferably comprise from about 5% to about 60% of detergent surfactant selected from the group consisting of anionic surfactants, nonionic surfactants, and mixtures thereof.

Liquid compositions of the present invention can contain water and other solvents. Lower molecular weight primary or secondary alcohols, exemplified by methanol, ethanol, propanol, and isopropanol, are suitable. Monohydric alcohols are preferred for solubilizing the surfactant, but polyols containing from about 2 to about 6 carbon atoms and from about 2 to about 6 hydroxy groups can be used and can provide improved enzyme stability (if enzymes are included in the composition). Examples of polyols include propylene glycol, ethylene glycol, glycerine and 1,2-propanediol. Ethanol is a particularly preferred alcohol.

The liquid compositions preferably comprise from about 5% to about 60% of detergent surfactant, about 7% to about 30% of builder and about 0.001% to about 5% PEI or salts thereof.

Useful detergency builders in liquid compositions include the alkali metal silicates, alkali metal carbonates, polyphosphonic acids, $C_{10}$–$C_{18}$ alkyl monocarboxylic acids, polycarboxylic acids, alkali metal, ammonium or substituted ammonium salts thereof, and mixtures thereof. In preferred liquid compositions, from about 8% to about 28% of the detergency builders are selected from the group consisting of $C_{10}$–$C_{18}$ alkyl monocarboxylic acids, polycarboxylic acids and mixtures thereof.

Particularly, preferred liquid compositions contain from about 8% to about 18% of a $C_{10}$–$C_{18}$ monocarboxylic (fatty) acid and from about 0.2% to about 10% of a polycarboxylic acid, preferably citric acid, and provide a solution pH of from about 6 to about 10 at 1.0% concentration in water.

Preferred liquid compositions are substantially free of inorganic phosphates or phosphonates. As used in this context "substantially free" means that the liquid compositions contain less than about 0.5% by weight of an inorganic phosphate- or phosphonate-containing compound.

The detergent compositions of the invention are particularly suitable for laundry use, but are also suitable for the cleaning of hard surfaces and for dishwashing.

In a laundry method aspect of the invention, typical laundry wash water solutions comprise from about 0.01% to about 5% by weight of the detergent compositions of the invention. Fabrics to be laundered are agitated in these solutions to effect cleaning and stain removal.

The detergent compositions of the present invention may be in any of the usual physical forms, such as powders, beads, flakes, bars, tablets, noodles, liquids, pastes and the like. The detergent compositions are prepared and utilized in the conventional manner. The wash solutions thereof desirably have a pH from about 6 to about 12, preferably from about 7 to about 11, more preferably from about 7.5 to about 10.

The following examples further describe and demonstrate the preferred embodiments that are within the scope of the invention. The examples are given solely for the purpose of illustration and are not to be construed as being limiting to the present invention since many variations are possible without departing from the spirit and scope of the invention.

EXAMPLES 1–6

The following Examples 1–6 represent the frame formulations of the present invention. These examples are not intended to be limiting to the present invention, but rather to simply further illustrate the additional aspects of the present technology which may be considered by the formulator when manufacturing a wide variety of detergent compositions comprising PEI chelants/sequestrants. Numerous modifications and variations are possible without departing from the spirit and scope of the present frame formulations. Unless otherwise indicated, all percentages herein are by weight.

Example 1

General Frame Formulations for Heavy-Duty Detergent Powders

| INGREDIENTS (BY WEIGHT) | | | | |
|---|---|---|---|---|
| Cleansing agents | 8–30 | 10–32 | 8–28 | 5–29 |
| PEI | 0.001–5 | 0.001–5 | 0.001–5 | 0.001–5 |
| Anti-corrosion agents | 0–25 | 0.3–12 | 1–9 | 4–15 |
| Builders | 5–45 | 5–45 | 2–35 | 0–25 |
| Cobuilders (alkalis) | 0–35 | 0–40 | 0–15 | 5–20 |
| Optical brighteners | 0–0.5 | 0–0.5 | 0–0.4 | 0–0.9 |
| Anti-redeposition agents | 0–3 | 0.2–2 | 0.3–4 | 0–2 |
| Enzymes | 0–2.7 | 0–0.8 | 0–1 | 0–0.8 |
| Foam-boosting agents | 0–2 | 0–2 | 0–2 | — |
| Suds-suppression agents | 0.01–3.5 | 0.01–3 | 0.01–4 | 0.01–3 |
| Fillers | 5–45 | 5–39 | 5–45 | 3–45 |
| Water | 6–20 | 6–13 | 4–20 | 5–10 |
| Additional detersive ingredients | Balance | Balance | Balance | Balance |

Example 2

Additional Frame Formulations for Heavy-Duty Detergent Powders

| INGREDIENTS (BY WEIGHT) | | | |
|---|---|---|---|
| Anionic Surfactants | | | |
| Alkylbenzene sulfonates | 5–20 | 5–22 | 5–27 |
| Alkyl sulfates | 0–20 | 0–25 | 0–15 |
| Alkyl ether sulfates | 0–20 | — | — |
| α-Olefin sulfonates | 0–15 | 0–15 | 0–15 |
| Nonionic Surfactants | | | |
| Alcohol ethoxylates | 3–17 | 3–12 | 0–10 |
| Nonylphenol ethoxylates | 0–5 | 0–5 | — |
| Alkyl polyglycosides | 0–15 | 0–15 | 0–15 |

-continued

Additional Frame Formulations for Heavy-Duty Detergent Powders

| INGREDIENTS (BY WEIGHT) | | | |
|---|---|---|---|
| Alkyl methyl glycamides | 0–18 | 0–18 | 0–18 |
| Alkyl aldonamides/aldobionamides | 0–25 | 0–25 | 0–25 |
| PEI | 0.001–5 | 0.001–5 | 0.001–5 |
| Anti-Corrosion Agents | | | |
| Sodium silicate | 0–25 | 1–9 | 4–15 |
| Builders (Ion Exchange) | | | |
| Zeolites | 5–49 | 2–35 | 0–25 |
| Polyacrylates | 0–9 | 0–8 | 0–7 |
| Builders | | | |
| Sodium citrate | 0–18 | 0–5 | 5–23 |
| Sodium tartrate mono-/disuccinate | 0–15 | 0–5 | — |
| Co-Builders (Alkalis) | | | |
| Sodium Carbonate | 0–35 | 0–15 | 5–20 |
| Co-Chelating Agents | | | |
| Ethylene diaminetetraacetates (EDTA) | 0–1 | 0–0.5 | — |
| Optical Brighteners | | | |
| Stilbenedisulfonic acid derivatives | 0–0.5 | 0–0.4 | 0–0.9 |
| Bis(styryl)biphenyl derivatives | 0–0.5 | 0–0.4 | 0–0.9 |
| Anti-Redeposition Agents | | | |
| Sodium carboxymethyl cellulose | 0–1.5 | 0.3–2 | 0–2.8 |
| Cellulose ethers | 0–1.5 | 0.3–2 | 0–2 |
| Polyethylene glycols | 0–3 | 0–4 | 0–2 |
| Enzymes | | | |
| Proteases | 0–2.7 | 0–1 | 0–0.8 |
| Amylases | 0–1 | 0–1 | 0–0.8 |
| Foaming Boosting Agents | | | |
| Alkanolamides | 0–2 | 0–2 | — |
| Suds-Suppression Agents | | | |
| Silicon oils | 0.01–1 | 0.01–4 | 0.01–3 |
| Fatty acid soaps | 0–3.5 | 0–4 | 0–3 |
| Fabric Softening Agents | | | |
| Quats | 0–5 | — | 0–6 |
| Clays | 0–5 | — | 0–6 |
| Fillers | | | |
| Sodium sulfate | 5–45 | 3–45 | 30–45 |
| Fragrances | 0–1 | 0–1 | 0–1 |
| Dyes/Blueing Agents | 0–1 | 0–1 | 0–1 |
| Water | 6–20 | 4–20 | 5–10 |
| Formulation Aids | 0–1 | 0–1 | 0–1 |
| Additional Detersive Ingredients | Balance | Balance | Balance |

Example 3

Frame Formulations for Heavy-Duty Detergent Liquids (Built and Unbuilt)

| INGREDIENTS (BY WEIGHT) | BUILT | UNBUILT | BUILT | UNBUILT | BUILT | UNBUILT |
|---|---|---|---|---|---|---|
| Anionic Surfactants | | | | | | |
| Alkylbenzene sulfonates | 5–27 | 0–20 | 5–17 | 10–25 | 5–25 | 0–23 |
| Alkyl sulfates | 0–15 | 0–15 | 0–22 | 0–25 | 0–23 | 0–18 |
| Alkyl ether sulfates | 0–25 | 0–22 | 0–20 | 0–22 | 5–20 | 15–25 |
| α-olefin sulfonates | 0–14 | — | — | 0–15 | 0–20 | |
| Nonionic Surfactants | | | | | | |
| Alcohol ethoxylates | 5–11 | 15–35 | 2–10 | 10–15 | 4–10 | 10–35 |
| Nonylphenol ethoxylates | 0–15 | 0–15 | 0–12 | 0–14 | 0–14 | 0–14 |
| Alkyl polyglycosides | 0–15 | 0–15 | 0–12 | 0–14 | 0–15 | 0–15 |
| Alkyl methyl glycamides | 0.1–45 | 0.1–45 | 0.1–45 | 0.1–45 | 0.1–45 | 0.1–45 |
| Alkyl aldonamides/ aldobionamides | 0–45 | 0–45 | 0–45 | 0–45 | 0–45 | 0–45 |
| PEI | 0.001–5 | 0.001–5 | 0.001–5 | 0.001–5 | 0.001–5 | 0.001–5 |
| Anti-Corrosion Agents | | | | | | |
| Sodium silicate | 0–12 | — | — | 0–3 | 3–7 | — |
| Builders | | | | | | |
| Sodium citrate | 1–12 | — | 1–5 | — | 3–7 | — |
| Co-chelating Agents | | | | | | |
| Ethylene diaminetetra-acetates (EDTA) | — | — | — | 0–3 | 0–3 | 0–5 |
| Optical Brighteners | | | | | | |
| Stilbenedisulfonic acid derivatives | 0–0.3 | 0–0.3 | 0–0.3 | 0–0.3 | 0–0.4 | 0–0.4 |
| Bis(styryl)biphenyl derivatives | 0–0.4 | 0–0.4 | 0–0.4 | 0–0.4 | 0–0.4 | 0–0.4 |
| Enzymes | | | | | | |
| Proteases | 0–1.8 | 0–2.5 | 0–0.5 | 0–1 | 0–0.5 | 0–1 |
| Enzyme Stabilizing Agents | | | | | | |
| Triethanolamine | 0–3 | 0–4 | 0–3 | 0–4 | 0–5 | 0–5 |
| Foaming Boosting Agents | | | | | | |
| Alkanolamides | — | — | 0–2 | — | — | — |
| Suds-Suppression Agents | | | | | | |
| Fatty acid soaps | — | — | 0–2 | — | — | — |
| Fabric Softening Agents | | | | | | |
| Quats | 0–2 | — | — | — | — | — |
| Clays | 0–2 | — | — | — | — | — |
| Hydrotropes/Solubilizing Agents | | | | | | |
| Xylene sulfonates | 0–14 | 0–12 | 0–6 | 0–12 | 0–15 | 0–15 |
| Ethanol | 7–14 | 5–12 | 3–6 | 6–12 | 10–15 | 5–15 |
| Propylene glycol | 7–14 | 5–12 | 3–10 | 6–14 | 5–15 | 5–18 |
| Fragrances | 0–1 | 0–1 | 0–1 | 0–1 | 0–1 | 0–1 |
| Dyes/Blueing Agents | 0–1 | 0–1 | 0–1 | 0–1 | 0–1 | 0–1 |
| Water and Additional Detersive Ingredients | Balance | Balance | Balance | Balance | Balance | Balance |

Example 4

Frame Formulations for Specialty Detergent Powders

| INGREDIENTS (BY WEIGHT) | | | | |
|---|---|---|---|---|
| Cleansing Agents | | | | |
| Anionic Surfactants | 5–15 | 0–15 | 0–10 | 12–25 |
| Nonionic Surfactants | 1–5 | 0.1–2.5 | 0.1–7 | 0–5 |
| Cationic Surfactants | — | 0–5 | — | — |
| Soaps | 1–5 | 0–5 | 1–4 | 0–5 |

-continued

Frame Formulations for Specialty Detergent Powders

| INGREDIENTS (BY WEIGHT) | | | | |
|---|---|---|---|---|
| PEI | 0.001–5 | 0.001–5 | 0.001–5 | 0.001–5 |
| Anti-Corrosion Agents | 2–7 | 2–7 | 3–7 | 3–9 |
| Builders | 25–40 | 25–35 | 25–40 | 25–35 |
| Enzymes | 0–0.4 | — | — | 0.2–0.5 |
| Optical Brighteners | 0–0.3 | 0–0.3 | 0.1–0.3 | 0–0.2 |
| Anti-Redeposition Agents | 0.5–1.5 | 0.5–1.5 | 0.5–1.5 | 0.5–1.5 |
| Suds Suppression Agents | 0–0.1 | 0–0.1 | 0–0.1 | 0–0.1 |
| Fragrances | 0–1 | 0–1 | 0–1 | 0–1 |

-continued

| Frame Formulations for Specialty Detergent Powders | | | | |
|---|---|---|---|---|
| INGREDIENTS (BY WEIGHT) | | | | |
| Fillers | 5–40 | 7–45 | 5–38 | 4–35 |
| Dyes | 0–1 | 0–1 | 0–1 | 0–1 |
| Water | 6–15 | 5–20 | 5–18 | 5–15 |
| Additional Detersive Ingredients | Balance | Balance | Balance | Balance |

Example 5

| Frame Formulations for Specialty Detergent Liquids | | | |
|---|---|---|---|
| INGREDIENTS (BY WEIGHT) | | | |
| Cleansing Agents | | | |
| Anionic Surfactants | — | 10–30 | 0–8 |
| Nonionic Surfactants | 1–30 | 2–5 | 1–30 |
| Cationic Surfactants | 1–5 | — | — |
| PEI | 0.001–5 | 0.001–5 | 0.001–5 |
| Builders | — | 0–15 | 2–5 |
| Viscosity Modifying/Solubilizing Agents | | | |
| Ethanol | 0–10 | 0–10 | 0–5 |
| Propyleneglycol | 0–10 | 0–10 | 0–5 |
| Hydrotropes | — | 0–3 | — |
| Optical Brighteners | 0–0.3 | 0–0.3 | 0–0.2 |
| Fragrances | 0–1 | 0–1 | 0–1 |
| Dyes | 0–1 | 0–1 | 0–1 |
| Water | 50–70 | 55–75 | 60–75 |
| Additional Detersive Ingredients | Balance | Balance | Balance |

Example 6

| Frame Formulations for Pre-Soak and Soak Detergent Powders | | |
|---|---|---|
| INGREDIENTS (BY WEIGHT) | Pre-Soak | Soaking |
| Cleansing Agents | | |
| Anionic Surfactants | 2–7 | 5–30 |
| Nonionic Surfactants | 0–2 | 1–15 |
| Soaps | 0–2 | — |
| PEI | 0.001–5 | 0.001–5 |
| Anti-Corrosion Agents | 1–10 | 1–10 |
| Builders | | |
| Sodium Carbonate | 50–80 | 50–80 |
| Anti-Redeposition Agents | 0–2 | 0–2 |
| Optical Brighteners | — | 0–0.3 |
| Fragrances | 0–1 | 0–1 |
| Fillers | 5–65 | 5–50 |
| Dyes | 0–0.5 | 0–0.5 |
| Water | 5–15 | 4–18 |
| Additional Detersive Ingredients | Balance | Balance |

Examples 7–41

To demonstrate the stain removal characteristics of detergent compositions containing PEI, three detergent compositions were prepared containing PEI and compared to identical compositions without PEI.

A great number of test methods have been developed to determine the performance of detergents and various detergent ingredients. A preferred, well-accepted test method involves applying various soils uniformly to a standard cloth under strict specifications yielding an "artificially soiled test cloth", which is then washed under controlled conditions in a Terg-o-tometer (washing machine simulator). The detergency of the sequestrant is assessed electronically using a reflectometer (Colorgard 2000). Before washing, the initial reflectance value of the soiled test cloth is measured (front and back) giving a value which is represented as reflectance-soiled ($R_s$) After washing, the final reflectance value of the soiled test cloth is measured (front and back) giving a value which is represented as reflectance-washed ($R_w$). From these values, the differences in reflectance $\Delta R=R_w-R_s$ can be calculated and used as a measure of soil removal. It shall be understood that higher $\Delta R$ values suggests better or enhanced detergency or improved stain removal.

In general, textiles come in contact with a variety of soils, some of which are complicated mixtures of materials differing in their chemical and physical structure. The selection of a model soil representing a natural "real life" soil is a complicated problem. However, significant progress has been made in the area of fabric washing making artificial soiling more realistic. Since it is not practical to test the PEI detergency with every possible soil that may be encountered, it must therefore be limited to typical model soils representing the most common natural soils. Artificial soils are usually selected to represent the following four types of common natural soils which includes (1) particulate soils, (2) fatty soils, (3) stains and (4) oily soils.

The stain removal characteristics of various PEI's were determined on various soils and stains. Each of the cloths were soiled with the following materials:

| CLOTH | SOIL |
|---|---|
| EMPA 114 | Cotton cloth soiled with red wine (stain) |
| CS-8 | Cotton cloth soiled with grass (stain) |
| CS-14 | Cotton cloth soiled with morello juice (stain) |
| CS-15 | Cotton cloth soiled with blueberry juice (stain) |
| Test fabrics tea | Cotton cloth soiled with tea (stain) |
| Test fabrics coffee | Cotton cloth soiled with coffee (stain) |

Below is a list of PEI's that were evaluated at concentrations of 0.01% to 5% by weight of the detergent formulation (1, 2 or 3) and compared to identical formulations without PEI.

| PEI | | |
|---|---|---|
| PEI | MOLECULAR WEIGHT | MANUFACTURER |
| PEI-700 | 700 | Aldrich |
| PEI-2000 | 2000 | Aldrich |
| Epomin SP012 | 1200 | Polymer Enterprises |
| Epomin P1050 | 70,000 | Polymer Enterprises |
| Lupasol G35 | 800 | BASF |
| Lupasol G20 | 1300 | BASF |
| Lupasol FG | 2000 | BASF |

The composition of three different detergent formulations are as follows:

| HEAVY DUTY LIQUID DETERGENT COMPOSITION COMPRISING PEI (FORMULATION 1) | |
|---|---|
| $C_{12}$–$C_{15}$ Alkyl sulfate | 9.0 |
| $C_{12}$–$C_{15}$ Alkyl ether (2.0) sulfate | 1.9 |
| $C_{12}$ Alkyl benzene sulfonate | 1.0 |
| $C_{12}$–$C_{18}$ Fatty acid soap | 7.6 |
| $C_{12}$–$C_{14}$ Alcohol ethoxylate with 7EO | 4.5 |
| Coconut Lactobionamide | 3.5 |
| Ethanolamine | 3.7 |

-continued

| | |
|---|---|
| Sodium citrate | 2.2 |
| PEI | 0.01–5 |
| Protease | 0.3 |
| Lipase | 0.2 |
| Amylase | 0.1 |
| Cellulase | 0.1 |
| Brightener | 0.2 |
| Boric acid | 0.4 |
| Fragrance | 0.2 |
| Ethanol | 1.9 |
| Propane-1,2-diol | 8.0 |
| Calcium chloride | 0.4 |
| Silicone oil | 0.2 |
| Polymer (PVP) | 1.0 |
| Sodium formate | 0.5 |
| Colorant | 0.02 |
| Water and Additional Detersive Ingredients | Balance |

HEAVY DUTY POWDERED DETERGENT COMPOSITION COMPRISING PEI (FORMULATION 2)

| | |
|---|---|
| $C_{12}$–$C_{15}$ Alkyl sulfate | 11.0 |
| $C_{12}$–$C_{14}$ Alkyl benzene sulfate | 4.0 |
| $C_{12}$–$C_{14}$ Alcohol ethoxylate with 6.5 EO | 15.0 |
| $C_{12}$–$C_{18}$ Fatty acid soap | 1.5 |
| Zeolite | 45.0 |
| Sodium citrate | 10.0 |
| Sodium carbonate | 3.5 |
| Sodium carboxylmethyl cellulose | 1.0 |
| PEI | 0.01–5 |
| Protease | 0.5 |
| Lipase | 0.3 |
| Amylase | 0.1 |
| Brightener | 0.15 |
| Fragrance | 0.1 |
| Water and Additional Detersive Ingredients | Balance |

HEAVY DUTY POWDERED DETERGENT COMPOSITION COMPRISING PEI (FORMULATION 3)

| | |
|---|---|
| $C_{10}$–$C_{16}$ Alkyl benzene sulfonate | 29.0 |
| Sodium triphosphate | 33.0 |
| Sodium carbonate | 21.0 |
| Sodium sulfate | 3.5 |
| Silica | 2.0 |
| Sodium carboxymethyl cellulose | 2.0 |
| PEI | 0.01–5 |
| Protease | 0.3 |
| Lipase | 0.1 |
| Amylase | 0.1 |
| Brightener | 0.5 |
| Fragrance | 0.4 |
| Speckles | 1.5 |
| Water and Additional Detersive Ingredients | Balance |

The wash conditions used to evaluate PEI sequestrants are as follows:

WASH CONDITIONS FOR PEI (PART 1)

| | |
|---|---|
| Apparatus | Terg-o-tometer |
| Wash time | 20 mins |
| Agitation | 70 rpm |
| Wash liquid volume | 1000 ml |
| Detergent | Formulation 1 or 2 |
| Dosage | 6.0 g/l - Formulation 1<br>3.3 g/l - Formulation 2 |
| pH | 8.5 - Formulation 1<br>9.5 - Formulation 2 |
| Hardness | 24 FH (4:1 Ca:Mg) (FH - French Hardness) |
| Metal ions | 2.3 ppm $Zn^{+2}$, 2 ppm $Fe^{+3}$, 1.1 PPM $Cu^{+2}$, 0.12 ppm $Mn^{+2}$ |
| Temperature | 40° C. |
| Test cloths | Four 3 × 4" cloths per (single stain) |
| Replicate washers | 1 to 3 separate washes |

Order of addition:

1. Add deionized water, hardness and metal ions
2. Add detergent Formulation 1 or 2
3. Add cloth
4. Wash (20 min.)
5. Rinse (1 min.)
6. Dry in dryer (10 min.)

Water containing the appropriate hardness and heavy metal ions were added followed by the addition of the detergent. Finally, artificially soiled 3×4" fabrics were added and washed for 20 minutes. The fabrics were then rinsed and dried in a dryer. One or three replicates of each treatment were conducted. The mean scores for each treatment was calculated and are represented as ΔR. It shall be understood that higher ΔR values suggest better or enhanced detergency/cleaning or stain removal. A statistical value was assigned to each score at a 95% confidence limit to counterbalance any variation associated with the test and to provide a reliable range associated with the mean.

WASH CONDITIONS FOR PEI (PART 2)

| | |
|---|---|
| Apparatus | Terg-o-tometer |
| Soak time | 20 mins |
| Wash time | 5 mins |
| Agitation | 100 rpm |
| Wash liquid volume | 1000 ml |
| Detergent | Formulation 3 |
| Dosage | 2.5 g/l |
| pH | 10 |
| Hardness | 24 FH (3:1 Ca:Mg) (FH = French Hardness) |
| Metal ions | 2.3 ppm $Zn^{+2}$, 2 ppm $Fe^{+3}$,<br>1.1 ppm $Cu^{+2}$ 0.12 ppm $Mn^{+2}$ |
| Temperature | 25° C. |
| Test cloths | Four 3 × 4" cloths per pot (single stain) |
| Replicate washers | 1 to 3 separate washes |

Order of addition:

1. Add deionized water, hardness and metal ions
2. Add detergent Formulation 3
3. Add cloth
4. Soak (20 min.)
5. Wash (5 min.)
6. Rinse (1 min.)
7. Dry in dryer (10 min.)

Water containing the appropriate hardness and heavy metal ions were added followed by the addition of the detergent. Finally artificially soiled 3×4" fabrics were added, soaked for 20 minutes and then washed for 5 minutes. The fabrics were then rinsed and dried flat on a rack in a dryer. One or three replicates of each treatment were conducted. The mean scores for each treatment was calculated and are represented as ΔR. It shall be understood that higher ΔR values suggest better or enhanced detergency/cleaning or stain removal. A statistical value was assigned to each score at 95% confidence limit to counterbalance any variation associated with the test and to provide a reliable range associated with the mean.

Example 7

| Stain Removal Characteristics of PEI-700 In Formulation 1 (pH = 8.5) (CS - 15) Blueberry | | | |
|---|---|---|---|
| | | 95% Confidence Limit | |
| PEI | One wash mean (ΔR) | High | Low |
| 0% | 19.8 ± 0.25 | 20.0 | 19.5 |
| 0.1% | 22.1 ± 0.25 | 22.3 | 21.8 |
| 1% | 21.2 ± 0.15 | 21.4 | 21.1 |
| 5% | 10.4 ± 0.2 | 10.6 | 10.2 |

From the above table, it can be seen that the addition of PEI (0.1 to 1%) to formulation 1 provides improved cleaning on blueberry stain. This improvement was found to be statistically better than the identical formulation without PEI (0%).

Example 8

| Stain Removal Characteristics of PEI-2000 In Formulation 1 (pH = 8.5) (CS - 15) Blueberry | | | |
|---|---|---|---|
| | | 95% Confidence Limit | |
| PEI | One wash mean (ΔR) | High | Low |
| 0% | 23.4 ± 0.2 | 23.6 | 23.2 |
| 0.01% | 19.6 ± 0.2 | 19.8 | 19.4 |
| 0.1% | 26.3 ± 0.25 | 26.5 | 26.0 |
| 0.25% | 26.1 ± 0.15 | 26.3 | 26.0 |
| 1% | 25.3 ± 0.15 | 25.4 | 25.1 |
| 5% | 21.4 ± 0.15 | 21.5 | 21.2 |

From the above table, it can be seen that the addition of PEI (0.1 to 1%) to formulation 1 provides improved cleaning on blueberry stain. This improvement was found to be statistically better than the identical formulation without PEI (0%).

Example 9

| Stain Removal Characteristics of PEI-2000 In Formulation 1 (pH = 8.5) (EMPA-114) Red Wine | | | |
|---|---|---|---|
| | | 95% Confidence Limit | |
| PEI | One wash mean (ΔR) | High | Low |
| 0% | 19.6 + 0.25 | 19.9 | 19.4 |
| 0.01% | 20.8 + 0.2 | 21.1 | 20.5 |
| 0.1% | 19.6 + 0.3 | 19.9 | 19.3 |
| 1% | 22.6 + 0.3 | 22.9 | 22.3 |
| 5% | 16.2 + 0.25 | 16.4 | 15.9 |

From the above table, it can be seen that the addition of PEI (0.01 to 1%) to formulation 1 provides improved cleaning on red wine stain. This improvement was found to be statistically better than the identical formulation without PEI (0%).

Example 10

| Stain Removal Characteristics of PEI-700 In Formulation 2 (pH = 9.5) (CS - 15) Blueberry | | | |
|---|---|---|---|
| | | 95% Confidence Limit | |
| PEI | One wash mean (ΔR) | High | Low |
| 0% | 16.4 ± 0.35 | 16.8 | 16.1 |
| 0.1% | 16.7 ± 0.25 | 16.9 | 16.4 |
| 1% | 17.0 ± 0.65 | 17.6 | 16.3 |
| 5% | 7.1 ± 0.2 | 7.3 | 8.9 |

From the above table, it can be seen that the addition of PEI (0.1 to 1%) to formulation 2 provides improved cleaning on blueberry stain. This improvement was found to be better than the identical formulation without PEI (0%).

Example 11

| Stain Removal Characteristics of PEI-700 In Formulation 2 (pH = 9.5) (CS - 15) Blueberry | | | |
|---|---|---|---|
| | | 95% Confidence Limit | |
| PEI | One wash mean (ΔR) | High | Low |
| 0% | 13.8 + 0.3 | 14.1 | 13.5 |
| 0.1% | 14.3 + 0.25 | 14.5 | 14.0 |
| 1% | 13.8 + 0.2 | 14.0 | 13.6 |
| 5% | 6.4 + 0.15 | 6.5 | 6.2 |

From the above table, it can be seen that the addition of PEI (0.1%) to formulation 2 provides improved cleaning on blueberry stain. This improvement was found to be better than the identical formulation without PEI (0%).

Example 12

| Stain Removal Characteristics of PEI-700 In Formulation 3 (pH = 10) (CS - 15) Blueberry | | | |
|---|---|---|---|
| | | 95% Confidence Limit | |
| PEI | One wash mean (ΔR) | High | Low |
| 0% | 16.2 + 0.15 | 16.4 | 16.1 |
| 0.1% | 16.7 + 0.3 | 17.0 | 16.4 |
| 1% | 16.9 + 0.25 | 17.1 | 16.6 |
| 5% | 14.5 + 0.15 | 14.6 | 14.3 |

From the above table, it can be seen that the addition of PEI (0.1 to 1%) to formulation 3 provides improved cleaning on blueberry stain. This improvement was found to be statistically better than the identical formulation without PEI (0%).

Example 13

| Stain Removal Characteristics of PEI-2000 In Formulation 3 (pH = 10) (CS - 15) Blueberry | | | |
|---|---|---|---|
| | | 95% Confidence Limit | |
| PEI | One wash mean (ΔR) | High | Low |
| 0% | 14.1 + 0.3 | 14.4 | 13.8 |
| 0.01% | 16.1 + 0.2 | 16.3 | 15.9 |
| 0.1% | 15.5 + 0.25 | 15.7 | 15.2 |
| 1% | 15.3 + 0.3 | 15.6 | 15.0 |
| 5% | 14.0 + 0.2 | 14.3 | 13.7 |

From the above table, it can be seen that the addition of PEI (0.01 to 1%) to formulation 3 provides improved cleaning on blueberry stain. This improvement was found to be statistically better than the identical formulation without PEI (0%).

Example 14

| Stain Removal Characteristics of PEI-2000 In Formulation 3 (pH = 10) (EMPA - 114) Red Wine | | | |
|---|---|---|---|
| | | 95% Confidence Limit | |
| PEI | One wash mean (ΔR) | High | Low |
| 0% | 12.8 ± 0.3 | 13.0 | 12.6 |
| 0.01% | 14.3 ± 0.3 | 14.5 | 14.0 |
| 0.1% | 14.3 ± 0.3 | 14.6 | 14.0 |
| 1% | 15.0 ± 0.2 | 15.2 | 14.8 |
| 5% | 14.0 ± 0.2 | 14.2 | 13.8 |

From the above table, it can be seen that the addition of PEI (0.1 to 5%) to formulation 3 provides improved cleaning on red wine stain. This improvement was found to be statistically better than the identical formulation without PEI (0%).

Example 15

| Stain Removal Characteristics of Lupasol G35 In Formulation 1 (pH = 8.5) (CS - 15) Blueberry | | | |
|---|---|---|---|
| | | 95% Confidence Limit | |
| PEI | One wash mean (ΔR) | High | Low |
| 0% | 19.2 ± 0.3 | 19.5 | 18.9 |
| 0.05% | 20.1 ± 0.25 | 20.3 | 19.8 |
| 0.1% | 20.7 ± 0.3 | 21.0 | 20.4 |
| 1% | 20.8 ± 0.2 | 21.0 | 20.6 |
| 2% | 19.3 ± 0.1 | 19.7 | 19.5 |

From the above table, it can be seen that the addition of PEI (0.05 to 2%) to formulation 1 provides improved cleaning on blueberry stain. This improvement was found to be statistically better than the identical formulation without PEI (0%).

Example 16

| Stain Removal Characteristics of Lupasol G35 In Formulation 1 (pH = 8.5) (EMPA - 114) Red Wine | | | |
|---|---|---|---|
| | | 95% Confidence Limit | |
| PEI | One wash mean (ΔR) | High | Low |
| 0% | 19.5 ± 0.25 | 19.0 | 19.4 |
| 0.05% | 20.7 ± 0.2 | 20.9 | 20.5 |
| 0.1% | 21.3 ± 0.25 | 21.6 | 21.1 |
| 1% | 21.8 ± 0.3 | 22.1 | 21.5 |
| 2% | 20.8 ± 0.25 | 21.1 | 20.6 |
| 3% | 22.2 ± 0.15 | 22.3 | 22.0 |
| 4% | 20.0 ± 0.25 | 20.3 | 19.8 |

From the above table, it can be seen that the addition of PEI (0.05 to 4%) to formulation 1 provides improved cleaning on red wine stain. This improvement was found to be statistically better than the identical formulation without PEI (0%).

Example 17

| Stain Removal Characteristics of Lupasol G35 In Formulation 1 (pH = 8.5) Test Fabrics Tea | | | |
|---|---|---|---|
| | | 95% Confidence Limit | |
| PEI | One wash mean (ΔR) | High | Low |
| 0% | 20.8 ± 0.15 | 20.9 | 20.6 |
| 0.05% | 21.3 ± 0.25 | 21.5 | 21.0 |
| 0.1% | 22.1 ± 0.65 | 22.7 | 21.4 |
| 1% | 21.9 ± 0.35 | 22.2 | 21.5 |
| 2% | 21.1 ± 0.25 | 21.3 | 20.8 |
| 3% | 19.9 ± 0.35 | 20.2 | 19.5 |
| 4% | 17.3 ± 0.35 | 17.6 | 16.9 |

From the above table, it can be seen that the addition of PEI (0.05 to 2%) to formulation 1 provides improved cleaning on tea stain. This improvement was found to be statistically better than the identical formulation without PEI (0%).

Example 18

| Stain Removal Characteristics of Lupasol G35 In Formulation 1 (pH = 8.5) Test Fabrics Coffee | | | |
|---|---|---|---|
| | | 95% Confidence Limit | |
| PEI | One wash mean (ΔR) | High | Low |
| 0% | 32.8 ± 0.8 | 33.6 | 32.0 |
| 0.05% | 37.1 ± 1.0 | 38.1 | 36.1 |
| 0.1% | 37.1 ± 0.7 | 37.8 | 36.4 |
| 1% | 37.8 ± 0.8 | 38.6 | 37.0 |
| 2% | 35.6 ± 0.5 | 36.1 | 35.1 |
| 3% | 34.8 ± 0.7 | 35.5 | 34.1 |
| 4% | 33.8 ± 0.6 | 34.4 | 33.2 |

From the above table, it can be seen that the addition of PEI (0.05 to 3%) to formulation 1 provides improved cleaning on coffee stain. This improvement was found to be statistically better than the identical formulation without PEI (0%).

Example 19

Stain Removal Characteristics of Lupasol G20 In Formulation 1 (pH = 8.5) (CS - 15) Blueberry

| PEI | One wash mean (ΔR) | 95% Confidence Limit High | 95% Confidence Limit Low |
|---|---|---|---|
| 0% | 19.2 ± 0.3 | 19.5 | 18.9 |
| 0.05% | 20.3 ± 0.3 | 20.6 | 20.0 |
| 0.1% | 20.8 ± 0.3 | 21.0 | 20.6 |
| 1% | 21.0 ± 0.2 | 21.3 | 20.8 |
| 2% | 19.8 ± 0.2 | 20.1 | 19.7 |

From the above table, it can be seen that the addition of PEI (0.05 to 2%) to formulation 1 provides improved cleaning on blueberry stain. This improvement was found to be statistically better than the identical formulation without PEI (0%).

Example 20

Stain Removal Characteristics of Lupasol G20 In Formulation 1 (pH = 8.5) (EMPA - 114) Red Wine

| PEI | One wash mean (ΔR) | 95% Confidence Limit High | 95% Confidence Limit Low |
|---|---|---|---|
| 0% | 19.6 ± 0.25 | 19.9 | 19.4 |
| 0.05% | 20.7 ± 0.2 | 20.9 | 20.5 |
| 0.1% | 21.3 ± 0.25 | 21.6 | 21.1 |
| 1% | 21.8 ± 0.25 | 22.0 | 21.5 |
| 2% | 20.8 ± 0.25 | 21.1 | 20.6 |
| 3% | 22.2 ± 0.15 | 22.3 | 22.0 |
| 4% | 20.0 ± 0.25 | 20.3 | 19.8 |

From the above table, it can be seen that the addition of PEI (0.05 to 3%) to formulation 1 provides improved cleaning on red wine stain. This improvement was found to be statistically better than the identical formulation without PEI (0%).

Example 21

Stain Removal Characteristics of Lupasol FG In Formulation 1 (pH = 8.5) (CS - 15) Blueberry

| PEI | One wash mean (ΔR) | 95% Confidence Limit High | 95% Confidence Limit Low |
|---|---|---|---|
| 0% | 19.2 ± 0.3 | 19.5 | 18.9 |
| 0.05% | 20.4 ± 0.25 | 20.7 | 20.2 |
| 0.1% | 20.6 ± 0.25 | 20.9 | 20.4 |
| 1% | 20.0 ± 0.25 | 20.3 | 19.8 |
| 2% | 18.7 ± 0.2 | 18.9 | 18.5 |

From the above table, it can be seen that the addition of PEI (0.05 to 1%) to formulation 1 provides improved cleaning on blueberry stain. This improvement was found to be statistically better than the identical formulation without PEI (0%).

Example 22

Stain Removal Characteristics of Lupasol FG In Formulation 1 (pH = 8.5) (EMPA - 114) Red Wine

| PEI | One wash mean (ΔR) | 95% Confidence Limit High | 95% Confidence Limit Low |
|---|---|---|---|
| 0% | 19.6 ± 0.25 | 19.9 | 19.4 |
| 0.05% | 21.4 ± 0.25 | 21.6 | 21.1 |
| 0.1% | 21.2 ± 0.35 | 21.5 | 20.8 |
| 1% | 21.3 ± 0.3 | 21.6 | 21.0 |
| 2% | 21.0 ± 0.3 | 21.3 | 20.7 |
| 3% | 21.7 ± 0.25 | 21.9 | 21.4 |
| 4% | 19.0 ± 0.25 | 19.2 | 18.7 |

From the above table, it can be seen that the addition of PEI (0.05 to 3%) to formulation 1 provides improved cleaning on red wine stain. This improvement was found to be statistically better than the identical formulation without PEI (0%).

Example 23

Stain Removal Characteristics of Lupasol G35 In Formulation 2 (pH = 9.5) (EMPA - 114) Red Wine

| PEI | One wash mean (ΔR) | 95% Confidence Limit High | 95% Confidence Limit Low |
|---|---|---|---|
| 0% | 12.8 ± 0.3 | 13.1 | 12.5 |
| 0.05% | 13.4 ± 0.25 | 13.6 | 13.1 |
| 0.1% | 13.5 ± 0.25 | 13.8 | 13.3 |
| 1% | 14.6 ± 0.3 | 14.9 | 14.3 |
| 2% | 14.6 ± 0.3 | 14.9 | 14.3 |
| 3% | 17.7 ± 0.2 | 15.9 | 15.5 |
| 4% | 13.0 ± 0.25 | 13.3 | 12.8 |

From the above table, it can be seen that the addition of PEI (0.05 to 3%) to formulation 2 provides improved cleaning on red wine stain. This improvement was found to be statistically better than the identical formulation without PEI (0%).

Example 24

Stain Removal Characteristics of Lupasol G20 In Formulation 2 (pH = 9.5) (EMPA - 114) Red Wine

| PEI | One wash mean (ΔR) | 95% Confidence Limit High | 95% Confidence Limit Low |
|---|---|---|---|
| 0% | 12.8 ± 0.3 | 13.1 | 12.5 |
| 0.05% | 12.4 ± 0.2 | 12.6 | 12.2 |
| 0.1% | 13.4 ± 0.35 | 13.7 | 13.0 |
| 1% | 14.5 ± 0.15 | 14.6 | 14.3 |
| 2% | 14.3 ± 0.15 | 14.5 | 14.2 |
| 3% | 14.3 ± 0.15 | 14.4 | 14.1 |
| 4% | 11.0 ± 0.15 | 11.2 | 10.9 |

From the above table, it can be seen that the addition of PEI (0.01 to 3%) to formulation 2 provides improved cleaning on red wine stain. This improvement was found to be statistically better than the identical formulation without PEI (0%).

Example 25

| Stain Removal Characteristics of Lupasol FG In Formulation 2 (pH = 9.5) (EMPA - 114) Red Wine | | | |
|---|---|---|---|
| | | 95% Confidence Limit | |
| PEI | One wash mean (ΔR) | High | Low |
| 0% | 12.8 ± 0.3 | 13.1 | 12.5 |
| 0.05% | 14.9 ± 0.2 | 15.1 | 14.7 |
| 0.1% | 15.2 ± 0.2 | 15.4 | 15.0 |
| 1% | 15.3 ± 0.2 | 15.5 | 15.1 |
| 2% | 13.1 ± 0.15 | 13.2 | 12.9 |
| 3% | 12.0 ± 0.25 | 12.2 | 11.7 |
| 4% | 10.1 ± 0.2 | 10.3 | 9.9 |

From the above table, it can be seen that the addition of PEI (0.05 to 2%) to formulation 2 provides improved cleaning on red wine stain. This improvement was found to be statistically better than the identical formulation without PEI (0%).

Example 26

| Stain Removal Characteristics of Lupasol G35 In Formulation 3 (pH = 10) Test Fabrics Tea | | | |
|---|---|---|---|
| | | 95% Confidence Limit | |
| PEI | One wash mean (ΔR) | High | Low |
| 0% | 11.3 ± 0.5 | 11.8 | 10.8 |
| 0.05% | 14.6 ± 0.25 | 14.8 | 14.3 |
| 0.1% | 14.2 ± 0.25 | 14.5 | 14.0 |
| 1% | 14.0 ± 0.2 | 14.2 | 13.8 |
| 2% | 13.3 ± 0.15 | 13.5 | 13.2 |
| 3% | 13.9 ± 0.15 | 14.1 | 13.8 |
| 4% | 12.2 ± 0.3 | 12.5 | 11.9 |

From the above table, it can be seen that the addition of PEI (0.05 to 4%) to formulation 3 provides improved cleaning on tea stain. This improvement was found to be statistically better than the identical formulation without PEI (0%).

Example 27

| Stain Removal Characteristics of Lupasol G20 In Formulation 3 (pH = 10) Test Fabrics Tea | | | |
|---|---|---|---|
| | | 95% Confidence Limit | |
| PEI | One wash mean (ΔR) | High | Low |
| 0% | 11.3 ± 0.5 | 11.8 | 10.8 |
| 0.05% | 13.1 ± 0.3 | 13.4 | 12.8 |
| 0.1% | 13.3 ± 0.35 | 13.7 | 13.0 |
| 1% | 13.0 ± 0.24 | 13.3 | 12.8 |
| 2% | 13.0 ± 0.4 | 13.4 | 12.6 |
| 3% | 12.5 ± 0.25 | 12.8 | 12.3 |
| 4% | 10.9 ± 0.25 | 11.2 | 10.7 |

From the above table, it can be seen that the addition of PEI (0.05 to 3%) to formulation 3 provides improved cleaning on tea stain. This improvement was found to be statistically better than the identical formulation without PEI (0%).

Example 28

| Stain Removal Characteristics of Lupasol FG In Formulation 3 (pH = 10) Test Fabrics Tea | | | |
|---|---|---|---|
| | | 95% Confidence Limit | |
| PEI | One wash mean (ΔR) | High | Low |
| 0% | 11.3 ± 0.5 | 11.8 | 10.8 |
| 0.05% | 11.9 ± 0.3 | 12.2 | 11.6 |
| 0.1% | 11.5 ± 0.35 | 11.9 | 11.2 |
| 1% | 11.6 ± 0.2 | 11.9 | 11.3 |
| 2% | 11.4 ± 0.35 | 11.8 | 11.1 |
| 3% | 11.2 ± 0.35 | 11.6 | 10.9 |
| 4% | 9.7 ± 0.3 | 10.0 | 9.4 |

From the above table, it can be seen that the addition of PEI (0.05%) to formulation 3 provides improved cleaning on tea stain. This improvement was found to be better than the identical formulation without PEI (0%).

Example 29

| Stain Removal Characteristics of Epomin SP012 In Formulation 1 (pH = 8.5) (CS - 8) Grass | | | |
|---|---|---|---|
| | | 95% Confidence Limit | |
| PEI | One wash mean (ΔR) | High | Low |
| 0% | 7.1 ± 1.4 | 7.5 | 6.7 |
| 0.05% | 8.2 ± 0.4 | 8.6 | 7.8 |
| 0.1% | 7.8 ± 0.45 | 8.3 | 7.4 |
| 1% | 8.4 ± 0.3 | 8.7 | 8.1 |
| 2% | 7.8 ± 0.35 | 8.2 | 7.5 |

From the above table, it can be seen that the addition of PEI (0.05 to 2%) to formulation 1 provides improved cleaning on grass stain. This improvement was found to be statistically better than the identical formulation without PEI (0%).

Example 30

| Stain Removal Characteristics of Epomin SP012 In Formulation 1 (pH = 8.5) (CS - 14) Morello Juice | | | |
|---|---|---|---|
| | | 95% Confidence Limit | |
| PEI | One wash mean (ΔR) | High | Low |
| 0% | 8.6 ± 0.3 | 8.9 | 8.3 |
| 0.05% | 9.8 ± 0.3 | 10.1 | 9.5 |
| 0.1% | 10.3 ± 0.3 | 10.6 | 10.0 |
| 1% | 10.3 ± 0.25 | 10.6 | 10.1 |
| 2% | 10.2 ± 0.3 | 10.5 | 9.9 |

From the above table, it can be seen that the addition of PEI (0.05 to 2%) to formulation 1 provides improved cleaning on morello juice stain. This improvement was found to be statistically better than the identical formulation without PEI (0%).

Example 31

| Stain Removal Characteristics of Epomin SP012 In Formulation 1 (pH = 8.5) (CS - 15) Blueberry | | | |
|---|---|---|---|
| | | 95% Confidence Limit | |
| PEI | One wash mean (ΔR) | High | Low |
| 0% | 18.3 ± 0.25 | 19.1 | 18.6 |
| 0.01% | 22.6 ± 0.25 | 22.8 | 22.3 |
| 1% | 22.4 ± 0.25 | 22.7 | 22.2 |
| 5% | 10.5 ± 0.4 | 10.9 | 10.1 |

From the above table, it can be seen that the addition of PEI (0.01 to 1%) to formulation 1 provides improved cleaning on blueberry stain. This improvement was found to be statistically better than the identical formulation without PEI (0%).

Example 32

| Stain Removal Characteristics of Epomin SP012 In Formulation 1 (pH = 8.5) (EMPA - 114) Red Wine | | | |
|---|---|---|---|
| | | 95% Confidence Limit | |
| PEI | One wash mean (ΔR) | High | Low |
| 0% | 19.6 ± 0.25 | 19.9 | 19.4 |
| 0.01% | 20.1 ± 0.25 | 20.3 | 19.9 |
| 0.1% | 21.8 ± 0.2 | 22.0 | 21.6 |
| 1% | 21.7 ± 0.25 | 21.9 | 21.4 |
| 3% | 23.0 ± 0.2 | 23.2 | 22.8 |
| 4% | 20.3 ± 0.2 | 20.5 | 20.1 |
| 5% | 14.7 ± 0.15 | 14.9 | 14.6 |

From the above table, it can be seen that the addition of PEI (0.01 to 4%) to formulation 1 provides improved cleaning on red wine stain. This improvement was found to be statistically better than the identical formulation without PEI (0%).

Example 33

| Stain Removal Characteristics of Epomin SP012 In Formulation 1 (pH = 8.5) Test Fabrics Tea | | | |
|---|---|---|---|
| | | 95% Confidence Limit | |
| PEI | One wash mean (ΔR) | High | Low |
| 0% | 19.4 ± 0.15 | 19.5 | 19.2 |
| 0.01% | 20.2 ± 0.15 | 20.3 | 20.1 |
| 0.01% | 20.2 ± 0.1 | 20.7 | 20.5 |
| 1% | 20.9 ± 0.1 | 21.0 | 20.8 |
| 5% | 14.1 ± 0.1 | 14.2 | 14.0 |

From the above table, it can be seen that the addition of PEI (0.01 to 1%) to formulation 1 provides improved cleaning on tea stain. This improvement was found to be statistically better than the identical formulation without PEI (0%).

Example 34

| Stain Removal Characteristics of Epomin SP012 In Formulation 1 (pH = 8.5) Test Fabrics Coffee | | | |
|---|---|---|---|
| | | 95% Confidence Limit | |
| PEI | One wash mean (ΔR) | High | Low |
| 0% | 32.1 ± 0.3 | 32.4 | 39.8 |
| 0.05% | 32.0 ± 0.35 | 32.4 | 31.7 |
| 0.1% | 33.3 ± 0.5 | 33.8 | 32.8 |
| 1% | 35.8 ± 0.35 | 36.1 | 35.4 |
| 2% | 34.0 ± 0.4 | 34.4 | 33.5 |

From the above table, it can be seen that the addition of PEI (0.1 to 2%) to formulation 1 provides improved cleaning on coffee stain. This improvement was found to be statistically better than the identical formulation without PEI (0%).

Example 35

| Stain Removal Characteristics of Epomin P1050 In Formulation 1 (pH = 8.5) (CS - 15) Blueberry | | | |
|---|---|---|---|
| | | 95% Confidence Limit | |
| PEI | One wash mean (ΔR) | High | Low |
| 0% | 18.3 ± 0.25 | 19.1 | 18.6 |
| 0.01% | 21.0 ± 0.4 | 21.4 | 20.6 |
| 1% | 23.2 ± 0.25 | 23.4 | 22.9 |
| 5% | 11.6 ± 0.2 | 11.8 | 11.4 |

From the above table, it can be seen that the addition of PEI (0.01 to 2%) to formulation 1 provides improved cleaning on blueberry stain. This improvement was found to be statistically better than the identical formulation without PEI (0%).

Example 36

| Stain Removal Characteristics of Epomin SP012 In Formulation 2 (pH = 9.5) (EMPA - 114) Red Wine | | | |
|---|---|---|---|
| | | 95% Confidence Limit | |
| PEI | One wash mean (ΔR) | High | Low |
| 0% | 12.8 ± 0.2 | 13.1 | 12.5 |
| 0.05% | 13.6 ± 0.2 | 13.8 | 13.4 |
| 0.1% | 14.4 ± 0.35 | 14.8 | 14.1 |
| 1% | 14.9 ± 0.5 | 15.0 | 14.9 |
| 2% | 15.2 ± 0.3 | 15.5 | 14.9 |
| 3% | 15.7 ± 0.2 | 15.9 | 15.5 |
| 4% | 13.0 ± 0.25 | 13.3 | 12.8 |

From the above table, it can be seen that the addition of PEI (0.05 to 3%) to formulation 2 provides improved cleaning on red wine stain. This improvement was found to be statistically better than the identical formulation without PEI (0%).

Example 37

| Stain Removal Characteristics of Epomin SP012 In Formulation 3 (pH = 10) Test Fabrics Tea | | | |
|---|---|---|---|
| | | 95% Confidence Limit | |
| PEI | One wash mean (ΔR) | High | Low |
| 0% | 11.3 ± 0.5 | 11.8 | 10.8 |
| 0.05% | 12.1 ± 0.3 | 12.4 | 11.8 |
| 0.1% | 11.3 ± 0.2 | 11.5 | 11.1 |
| 1% | 11.4 ± 0.25 | 11.7 | 11.2 |
| 2% | 10.8 ± 0.2 | 11.0 | 10.6 |
| 3% | 11.7 ± 0.25 | 12.0 | 11.5 |
| 4% | 10.4 ± 0.25 | 10.7 | 10.2 |

From the above table, it can be seen that the addition of PEI (0.05%) to formulation 3 provides improved cleaning on tea stain. This improvement was found to be better than the identical formulation without PEI (0%).

Example 38

| Stain Removal Characteristics of Epomin SP012 In Formulation 3 (pH = 10) Test Fabrics Coffee | | | |
|---|---|---|---|
| | | 95% Confidence Limit | |
| PEI | One wash mean (ΔR) | High | Low |
| 0% | 27.5 ± 0.95 | 28.5 | 26.6 |
| 0.05% | 27.4 ± 0.55 | 28.0 | 26.9 |
| 0.1% | 27.6 ± 0.6 | 28.2 | 27.0 |
| 1% | 29.6 ± 0.4 | 30.0 | 29.2 |
| 2% | 30.3 ± 0.5 | 30.8 | 28.8 |
| 3% | 29.2 ± 0.9 | 30.1 | 28.3 |
| 4% | 28.5 ± 1.2 | 29.7 | 27.4 |

From the above table, it can be seen that the addition of PEI (1 to 2%) to formulation 3 provides improved cleaning on coffee stain. This improvement was found to be statistically better than the identical formulation without PEI (0%).

Example 39

| Stain Removal Characteristics of Epomin P1050 In Formulation 3 (pH = 10) Test Fabrics Tea | | | |
|---|---|---|---|
| | | 95% Confidence Limit | |
| PEI | One wash mean (ΔR) | High | Low |
| 0% | 11.3 ± 0.5 | 11.8 | 10.8 |
| 0.05% | 13.1 ± 0.15 | 13.3 | 13.0 |
| 0.1% | 12.9 ± 0.15 | 13.1 | 12.9 |
| 1% | 12.5 ± 0.2 | 12.7 | 12.3 |
| 2% | 12.7 ± 0.15 | 12.9 | 12.6 |
| 3% | 12.2 ± 0.15 | 12.4 | 12.1 |
| 4% | 11.2 ± 0.2 | 11.4 | 11.0 |

From the above table, it can be seen that the addition of PEI (0.05 to 3%) to formulation 3 provides improved cleaning on tea stain. This improvement was found to be statistically better than the identical formulation without PEI (0%).

Example 40

| Stain Removal Characteristics of Epomin P1050 In Formulation 3 (pH = 10) Test Fabrics Tea | | | |
|---|---|---|---|
| | | 95% Confidence Limit | |
| PEI | One wash mean (ΔR) | High | Low |
| 0% | 20.7 ± 0.15 | 20.9 | 20.6 |
| 0.01% | 20.8 ± 0.2 | 21.0 | 20.6 |
| 0.1% | 21.1 ± 0.25 | 21.4 | 20.9 |
| 1% | 21.5 ± 0.4 | 21.9 | 21.1 |
| 3% | 21.2 ± 0.3 | 21.5 | 20.9 |
| 4% | 20.4 ± 0.35 | 20.8 | 20.1 |
| 5% | 19.2 ± 0.45 | 19.6 | 18.7 |

From the above table, it can be seen that the addition of PEI (0.01 to 3%) to formulation 3 provides improved cleaning on tea stain. This improvement was found to be statistically better than the identical formulation without PEI (0%).

Example 41

| Stain Removal Characteristics of Epomin P1050 In Formulation 3 (pH = 10) Test Fabrics Coffee | | | |
|---|---|---|---|
| | | 95% Confidence Limit | |
| PEI | One wash mean (ΔR) | High | Low |
| 0% | 26.5 ± 0.95 | 27.5 | 25.6 |
| 0.05% | 27.2 ± 0.45 | 27.7 | 26.8 |
| 0.1% | 28.2 ± 0.75 | 29.0 | 27.5 |
| 1% | 28.1 ± 0.6 | 28.7 | 27.5 |
| 2% | 26.9 ± 0.4 | 27.3 | 26.5 |
| 3% | 27.1 ± 0.7 | 27.8 | 26.4 |
| 4% | 27.1 ± 0.8 | 27.9 | 26.3 |

From the above table, it can be seen that the addition of PEI (0.1 to 1%) to formulation 3 provides improved cleaning on coffee stain. This improvement was found to be better than the identical formulation without PEI (0%).

Discussion of Examples 7–41

From Examples 7–41, it can be seen that the addition of 0.01 to 5% of PEI to various detergent formulations enhance the removal of red wine, grass, morello juice (cherry juice), blueberry juice, tea and coffee stain from fabric. Based on this unexpected discovery, it is now possible to also effectively remove stain from hard surfaces, eating utensils, kitchenware, dentures and the like. Therefore, the following example is now presented (Example 42).

Example 42

| Frame Formulations For Light-Duty Dishwashing Detergent Liquids | |
|---|---|
| INGREDIENTS (BY WEIGHT) | |
| Anionic Surfactants | |
| Alkylbenzene sulfonates | 1–25 |
| Alkyl sulfates | 2–10 |
| Alkyl ether sulfates | 2–23 |
| Fatty acid soaps | 0–3 |
| Nonionic Surfactants | |
| Alcohol ethoxylates | 0–15 |
| Alkyl polyglycosides | 0–20 |
| Alkyl methyl glycamides | 0–18 |
| Alkyl aldonamides/aldobionamides | 0–30 |

-continued

| Frame Formulations For Light-Duty Dishwashing Detergent Liquids | |
|---|---|
| INGREDIENTS (BY WEIGHT) | |
| Amphoteric Surfactants | |
| Alkyl betaines | 0.3 |
| PEI | 0.001–5 |
| Builders | |
| Sodium citrate | 0–5 |
| Co-chelating Agents | |
| Ethylene diaminetetraacetates (EDTA) | 0–3 |
| Foaming Boosting Agents | |
| Alkanolamides | 0–8 |
| Hydrotropes/Solubilizing Agents | |
| Xylene sulfonates | 0–2 |
| Ethanol | 0–10 |
| Viscosity Modifying Agent | |
| Sodium chloride | 0–4 |
| Ions | |
| Magnesium sulfate | 0–2 |
| Opacifiers | 0–2 |
| Fragrances | 0–1 |
| Dyes | 0–1 |
| Water and Additional Detersive Ingredients | Balance |

It should be understood that the specific forms of the invention herein illustrated and described are intended to be representative only. Changes, including but not limited to those suggested in this specification, may be made in the illustrated embodiments without departing from the clear teachings of the disclosure. Accordingly, reference should be made to the following appended claims in determining the full scope of the invention.

What is claimed is:

1. A detergent composition consisting essentially of:

(a) from about 1% to about 75% by weight of a detergent surfactant selected from the group consisting of nonionic surfactants, switterionic surfactants, ampholytic surfactants, cationic surfactants, and mixtures thereof;

(b) from about 5% to about 80% by weight of a detergency builder;

(c) from about 0.001% to about 5% by weight of an enzyme; and (d) from about 0.001% to about 5% by weight polyethyleneimine, polyethyleneimine salt, or mixtures thereof, wherein said polyethyleneimine or salts thereof have an average molecular weight of at least about 1200 and wherein said composition is free of anionic surfactants.

2. The composition of claim 1 wherein the detergency builder component is selected from the group consisting of zeolite; alkali metal silicates; alkali metal carbonates; alkali metal phosphates; alkali metal polyphosphates; alkali metal phosphonates; alkali metal polyphosphonic acids; $C_8$–$C_{18}$ alkyl monocarboxylic acids, polycarboxylic acids, alkali metal, ammonium or substituted ammonium salts thereof; and mixtures thereof.

3. The composition of claim 1 comprising from 0.005% to about 4.5% of polyethyleneimine or the salts thereof, or mixtures thereof.

4. The composition of claim 3 wherein polyethyleneimine component is selected from the group consisting of polyethyleneimines, polyethyleneimine salts or mixtures thereof wherein each of the polyethyleneimines or salts thereof have a molecular weight of about 1200 to about 2,500,000.

5. The composition of claim 3 wherein the polyethyleneimine component is in the non-protonated, non-salt form.

6. The composition of claim 1 wherein the surfactant component comprises a nonionic surfactant selected from the group consisting of $C_{10}$–$C_{20}$ alcohols ethoxylated with an average of from about 4 to about 10 moles of ethylene oxide per mole of alcohol, alkyl polyglycosides, alkyl aldonamides, alkyl aldobionamides, alkyl glycamides and mixtures thereof.

7. A liquid laundry detergent composition consisting essentially of:

(a) from about 5% to about 60% by weight of a detergent surfactant selected from the group consisting of nonionic surfactants, zwitterionic surfactants, ampholytic surfactants, cationic surfactants, and mixtures thereof;

(b) from about 7% to about 30% by weight of a detergency builder selected from the group consisting of zeolite; alkali metal silicates; alkali metal carbonates; polyphosphonic acids; $C_8$–$C_{18}$ alkyl monocarboxylic acids, polycarboxylic acids, alkali metal, ammonium or substituted ammonium salts thereof, and mixtures thereof;

(c) from about 0.001% to about 5% by weight of an enzyme; and (d) from about 0.001% to about 5% by weight polyethyleneimine, polyethyleneimine salt or mixtures thereof, wherein said polyethyleneimine or salts thereof have an average molecular weight of at least about 1200 and wherein said composition is free of anionic surfactants.

8. The composition of claim 7 comprising from about 10% to about 28% by weight of a detergency builder selected from the group consisting of $C_8$–$C_{18}$ alkyl monocarboxylic acids, polycarboxylic acids, and mixtures thereof.

9. The composition of claim 8 comprising, as the detergency builder, from about 5% to about 18% by weight of $C_8$–$C_{18}$ alkyl monocarboxylic acid, and from about 0.2% to about 10% by weight of citric acid or salts thereof.

10. The composition of claim 7 comprising from about 0.005% to about 4.5% polyethyleneimine, polyethyleneimine salts, or mixtures thereof.

11. The composition of claim 10 wherein polyethyleneimine component is selected from the group consisting of polyethyleneimine, polyethyleneimine salts or mixtures thereof wherein each of the polyethyleneimines or salts thereof have a molecular weight of about 1200 to about 2,500,000.

12. The composition of claim 7 which is free of inorganic phosphates or polyphosphates.

13. The composition of claim 7 wherein the surfactant component comprises a nonionic surfactant selected from the group consisting of $C_{10}$–$C_{20}$ alcohols ethoxylated with an average of from about 4 to about 10 moles of ethylene oxide per mole of alcohol, alkyl polyglycosides, alkyl aldonamides, alkyl aldobionamides, alkyl glycamides and mixtures thereof.

14. The composition of claim 7 having a pH of from about 6 to about 12 at 1% by weight concentration in water.

15. A granular laundry detergent composition consisting essentially of:

(a) from about 5% to about 60% by weight of a nonionic detergent surfactant;

(b) from about 10% to about 50% by weight of a detergency builder selected from the group consisting of zeolite; alkali metal silicates, alkali metal carbonates, alkali metal phosphates, alkali metal polyphosphates, alkali metal polyphosphonic acids; $C_8$–$C_{18}$ alkyl monocarboxylic acids, polycarboxylic acids, alkali metal, ammonium or substituted ammonium salts thereof, and mixtures thereof; and (c) from about 0.001% to about 5% by weight of an enzyme; and (d) from about 0.001% to about 5% by weight polyethyleneimine, polyethyleneimine salt or mixtures thereof, (e) wherein said polyethyleneimine or salts thereof have an average molecular weight of at least about 1200 and wherein said composition is free of anionic surfactants.

16. The composition of claim 15 which comprises from about 0.005% to about 4.5% polyethyleneimine, polyethyleneimine salts, or mixtures thereof.

17. The composition of claim 16 wherein the polyethyleneimine component is selected from the group consisting of polyethyleneimines, polyethyleneimine salts or mixtures thereof wherein each of the polyethyleneimines or salts thereof have a molecular weight of about 1200 to about 2,500,000.

18. The composition of claim 15 wherein the surfactant component comprises a nonionic surfactant selected from the group consisting of $C_{10}$–$C_{20}$ alcohols ethoxylated with an average of from about 4 to about 10 moles of ethylene oxide per mole of alcohol, alkylpolyglycosides, alkyl aldonamides, alkyl aldobionamides, alkyl glycamides and mixtures thereof.

19. A method for laundering fabrics comprising the agitation of said fabrics in an aqueous solution containing from about 0.01% to about 5% by weight of the composition of claim 1.

20. A method for laundering fabrics comprising the agitation of said fabrics in an aqueous solution containing from about 0.01% to about 5% by weight of the composition of claim 7.

21. A method for laundering fabrics comprising the agitation of said fabrics in an aqueous solution containing from about 0.01% to about 5% by weight of the composition of claim 15.

* * * * *